US008680787B2

(12) United States Patent
Veskovic

(10) Patent No.: US 8,680,787 B2
(45) Date of Patent: Mar. 25, 2014

(54) LOAD CONTROL DEVICE FOR A LIGHT-EMITTING DIODE LIGHT SOURCE

(75) Inventor: Dragan Veskovic, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 182 days.

(21) Appl. No.: 13/416,741

(22) Filed: Mar. 9, 2012

(65) Prior Publication Data

US 2013/0063047 A1 Mar. 14, 2013

Related U.S. Application Data

(60) Provisional application No. 61/452,867, filed on Mar. 15, 2011.

(51) Int. Cl.
*H05B 37/02* (2006.01)
*H05B 39/06* (2006.01)

(52) U.S. Cl.
USPC ..... 315/307; 315/219; 315/200 R; 315/246

(58) Field of Classification Search
USPC ..... 315/200 R, 209 R, 209, 224, 246, 291, 315/307–309
See application file for complete search history.

(56) References Cited

U.S. PATENT DOCUMENTS

| | | | |
|---|---|---|---|
| 4,195,281 | A | 3/1980 | Bell |
| 4,503,311 | A | 3/1985 | Houchens et al. |
| 4,504,776 | A | 3/1985 | Haville |
| 4,845,481 | A | 7/1989 | Havel |
| 4,964,135 | A | 10/1990 | Mitsui et al. |
| 5,017,837 | A | 5/1991 | Hanna et al. |
| 5,041,763 | A | 8/1991 | Sullivan et al. |
| 5,399,940 | A | 3/1995 | Hanna et al. |
| 5,661,645 | A | 8/1997 | Hochstein |

(Continued)

FOREIGN PATENT DOCUMENTS

| | | |
|---|---|---|
| DE | 102006028670 | 12/2007 |
| EP | 1 499 165 A2 | 4/2009 |

(Continued)

OTHER PUBLICATIONS

International Preliminary Report on Patentability dated May 4, 2012 issued in PCT International Application No. PCT/US10/051405.

(Continued)

*Primary Examiner* — Don Le
(74) *Attorney, Agent, or Firm* — Ostrolenk Faber LLP

(57) ABSTRACT

An LED driver for controlling the intensity of an LED light source includes a power converter circuit for generating a DC bus voltage, an LED drive circuit for receiving the bus voltage and controlling a load current through, and thus the intensity of, the LED light source, and a controller operatively coupled to the power converter circuit and the LED drive circuit. The LED drive circuit comprises a controllable-impedance circuit coupled in series with the LED light source. The controller adjusts the magnitude of the bus voltage to a target bus voltage and generates a drive signal for controlling the controllable-impedance circuit. To adjust the intensity of the LED light source, the controller controls the magnitudes of both the load current and the regulator voltage. The controller controls the magnitude of the regulator voltage by simultaneously maintaining the magnitude of the drive signal constant and adjusting the target bus voltage.

22 Claims, 11 Drawing Sheets

(56) References Cited

U.S. PATENT DOCUMENTS

| | | | |
|---|---|---|---|
| 5,905,442 | A | 5/1999 | Mosebrook et al. |
| 6,016,038 | A | 1/2000 | Mueller et al. |
| 6,040,663 | A | 3/2000 | Bucks et al. |
| 6,091,614 | A | 7/2000 | Malenfant |
| 6,111,368 | A | 8/2000 | Luchaco |
| 6,150,771 | A | 11/2000 | Perry |
| 6,304,464 | B1 | 10/2001 | Jacobs et al. |
| 6,577,512 | B2 | 6/2003 | Tripathi et al. |
| 6,580,309 | B2 | 6/2003 | Jacobs et al. |
| 6,586,890 | B2 | 7/2003 | Min et al. |
| 6,621,235 | B2 | 9/2003 | Chang |
| 6,734,639 | B2 | 5/2004 | Chang et al. |
| 6,747,420 | B2 | 6/2004 | Barth et al. |
| 6,853,150 | B2 | 2/2005 | Clauberg et al. |
| 6,870,325 | B2 | 3/2005 | Bushell et al. |
| 7,019,662 | B2 | 3/2006 | Shackle |
| 7,038,399 | B2 | 5/2006 | Lys et al. |
| 7,071,762 | B2 | 7/2006 | Xu et al. |
| 7,169,481 | B2 | 1/2007 | Ogawa et al. |
| 7,202,608 | B2 | 4/2007 | Robinson et al. |
| 7,233,115 | B2 | 6/2007 | Lys |
| 7,242,152 | B2 | 7/2007 | Dowling et al. |
| 7,256,554 | B2 | 8/2007 | Lys |
| 7,262,559 | B2 | 8/2007 | Tripathi et al. |
| 7,309,965 | B2 | 12/2007 | Dowling et al. |
| 7,352,138 | B2 | 4/2008 | Lys |
| 7,358,681 | B2 | 4/2008 | Robinson et al. |
| 7,358,706 | B2 | 4/2008 | Lys |
| 7,378,805 | B2 | 5/2008 | Oh et al. |
| 7,420,335 | B2 | 9/2008 | Robinson et al. |
| 7,459,864 | B2 | 12/2008 | Lys |
| 7,463,070 | B2 | 12/2008 | Wessels |
| 7,482,565 | B2 | 1/2009 | Morgan et al. |
| 7,482,760 | B2 | 1/2009 | Jungwirth et al. |
| 7,504,781 | B2 | 3/2009 | Wendt et al. |
| 7,511,436 | B2 | 3/2009 | Xu |
| 7,511,437 | B2 | 3/2009 | Lys et al. |
| 7,538,499 | B2 | 5/2009 | Ashdown |
| 7,541,785 | B2 | 6/2009 | Murakami |
| 7,542,257 | B2 | 6/2009 | McCormick et al. |
| 7,550,935 | B2 | 6/2009 | Lys et al. |
| 7,557,521 | B2 | 7/2009 | Lys |
| 7,573,729 | B2 | 8/2009 | Elferich et al. |
| 8,466,628 | B2 | 6/2013 | Shearer et al. |
| 8,492,987 | B2 | 7/2013 | Nuhfer et al. |
| 8,492,988 | B2 | 7/2013 | Nuhfer et al. |
| 2003/0025120 | A1 | 2/2003 | Chang |
| 2003/0025514 | A1 | 2/2003 | Benes |
| 2003/0214242 | A1 | 11/2003 | Berg-johansen |
| 2004/0252486 | A1 | 12/2004 | Krause |
| 2005/0093488 | A1 | 5/2005 | Hung et al. |
| 2005/0111231 | A1 | 5/2005 | Crodian et al. |
| 2005/0230600 | A1 | 10/2005 | Olson et al. |
| 2007/0019442 | A1 | 1/2007 | Li et al. |
| 2007/0108916 | A1 | 5/2007 | Wang et al. |
| 2007/0195527 | A1 | 8/2007 | Russell |
| 2008/0018261 | A1 | 1/2008 | Kastner |
| 2008/0100234 | A1 | 5/2008 | Chen |
| 2008/0122385 | A1 | 5/2008 | Dou et al. |
| 2008/0150877 | A1 | 6/2008 | Chao et al. |
| 2008/0174929 | A1 | 7/2008 | Shen et al. |
| 2008/0180075 | A1 | 7/2008 | Xie et al. |
| 2008/0219001 | A1 | 9/2008 | Russell |
| 2008/0224625 | A1 | 9/2008 | Greenfeld |
| 2008/0224629 | A1 | 9/2008 | Melanson |
| 2008/0224636 | A1 | 9/2008 | Melanson |
| 2008/0258641 | A1 | 10/2008 | Nakagawa et al. |
| 2008/0290906 | A1 | 11/2008 | Chou |
| 2008/0315795 | A1 | 12/2008 | Madineni et al. |
| 2009/0108776 | A1 | 4/2009 | Zhao |
| 2009/0134816 | A1 | 5/2009 | Sloan et al. |
| 2009/0140666 | A1 | 6/2009 | Liao et al. |
| 2009/0187925 | A1 | 7/2009 | Hu et al. |
| 2009/0195168 | A1 | 8/2009 | Greenfeld |
| 2009/0230880 | A1 | 9/2009 | Wang |
| 2009/0230891 | A1 | 9/2009 | Zhao et al. |
| 2009/0295775 | A1 | 12/2009 | Kim et al. |
| 2011/0018450 | A1 | 1/2011 | Hsu |
| 2011/0121744 | A1 | 5/2011 | Salvestrini et al. |
| 2012/0286689 | A1* | 11/2012 | Newman et al. ..... 315/246 |
| 2013/0018522 | A1 | 1/2013 | Nuhfer et al. |
| 2013/0020964 | A1 | 1/2013 | Nuhfer et al. |

FOREIGN PATENT DOCUMENTS

| | | |
|---|---|---|
| EP | 2257130 | 12/2010 |
| JP | 2001-093662 A | 4/2001 |
| WO | WO-2008-068705 | 6/2008 |
| WO | WO-2008-112820 | 9/2008 |
| WO | WO-2008/144961 | 12/2008 |
| WO | WO-2009/040305 | 4/2009 |
| WO | WO-2009/119617 | 10/2009 |

OTHER PUBLICATIONS

International Preliminary Report on Patentability dated Feb. 27, 2012 issued in PCT International Application No. PCT/US10/51315.
International Preliminary Report on Patentability dated Mar. 2, 2012 issued in PCT International Application No. PCT/US10/51402.
International Search Report and Written Opinion dated Jun. 25, 2012 in International Application No. PCT/US2012/028906.
Search Report issued by PCT on Jan. 21, 2011 in connection with PCT application No. PCT/US2010/051402.
Search Report issued by PCT on Jan. 21, 2011 in connection with PCT application No. PCT/US2010/051405.
Search Report issued by PCT on Jan. 21, 2011 in connection with PCT application No. PCT/US2010/051315.
Cypress CY8CLEDAC02 Data Sheet, Cypress Semiconductor Corporation, revised Jul. 30, 2009, pp. 1-15.

* cited by examiner

LOAD CONTROL DEVICE FOR A LIGHT-EMITTING DIODE LIGHT SOURCE

CROSS-REFERENCE TO RELATED APPLICATIONS

This application is a non-provisional application of commonly-assigned U.S. Provisional Application No. 61/452,867, filed Mar. 15, 2011, entitled LOAD CONTROL DEVICE FOR A LIGHT-EMITTING DIODE LIGHT SOURCE, the entire disclosure of which is hereby incorporated by reference.

BACKGROUND OF THE INVENTION

1. Field of the Invention

The present invention relates to a load control device for a light-emitting diode (LED) light source, and more particularly, to an LED driver for controlling the intensity of an LED light source.

2. Description of the Related Art

Light-emitting diode (LED) light sources are often used in place of or as replacements for conventional incandescent, fluorescent, or halogen lamps, and the like. LED light sources may comprise a plurality of light-emitting diodes mounted on a single structure and provided in a suitable housing. LED light sources are typically more efficient and provide longer operational lives as compared to incandescent, fluorescent, and halogen lamps. In order to illuminate properly, an LED driver control device (i.e., an LED driver) must be coupled between an alternating-current (AC) source and the LED light source for regulating the power supplied to the LED light source. The LED driver may regulate either the voltage provided to the LED light source to a particular value, the current supplied to the LED light source to a specific peak current value, or may regulate both the current and voltage.

The prior art dealing with LED drivers is extensive. See, for example, the listing of U.S. and foreign patent documents and other publications in U.S. Pat. No. 7,352,138, issued Apr. 1, 2008, assigned to Philips Solid-State Lighting Solutions, Inc., of Burlington, Mass., and U.S. Pat. No. 6,016,038, issued Jan. 18, 2000, assigned to Color Kinetics, Inc., of Boston, Mass. (hereinafter "CK").

LED drivers are well known. For example, U.S. Pat. No. 6,586,890, issued Jul. 1, 2003, assigned to Koninklijke Philips Electronics N.V., of Eindhoven, the Netherlands (hereinafter "Philips"), discloses a driver circuit for LEDs that provide power to the LEDs by using pulse-width modulation (PWM). Other examples of LED drivers are U.S. Pat. No. 6,580,309, published Sep. 27, 2001, assigned to Philips, which describes switching an LED power supply unit on and off using a pulse duration modulator to control the mean light output of the LEDs. Moreover, the aforementioned U.S. Pat. No. 6,016,038 also describes using PWM signals to alter the brightness and color of LEDs. Further, U.S. Pat. No. 4,845,481, issued Jul. 4, 1989 to Karel Havel, discloses varying the duty cycles of supply currents to differently colored LEDs to vary the light intensities of the LEDs so as to achieve continuously variable color mixing.

U.S. Pat. No. 6,586,890 also discloses a closed-loop current power supply for LEDs. Closed-loop current power supplies for supplying power to other types of lamps are also well known. For example, U.S. Pat. No. 5,041,763, issued Aug. 20, 1991, assigned to Lutron Electronics Co., Inc. of Coopersburg, Pa. (hereinafter "Lutron"), describes closed-loop current power supplies for fluorescent lamps that can supply power to any type of lamp.

U.S. Pat. No. 6,577,512, issued Jun. 10, 2003, assigned to Philips, discloses a power supply for LEDs that uses closed-loop current feedback to control the current supplied to the LEDs and includes means for protecting the LEDs. Likewise, U.S. Pat. No. 6,150,771, issued Nov. 21, 2000, assigned to Precision Solar Controls Inc., of Garland, Tex., and Japanese patent publication 2001093662A, published Apr. 6, 2001, assigned to Nippon Seiki Co., Ltd., describe over-current and over-voltage protection for drivers for LEDs and other lamps.

LED drivers that may be dimmed by conventional A.C. dimmers are also known. Thus, aforementioned U.S. Pat. No. 7,352,138, and U.S. Pat. No. 7,038,399, issued May 2, 2006, assigned to CK, describe LED-based light sources that are controlled by conventional A.C. phase control dimmers. The aforementioned U.S. Pat. No. 6,016,038 discloses a PWM controlled LED-based light source used as a light bulb that may be placed in an Edison-mount (screw-type) light bulb housing. Control of lamps, such as LED lamps, by phase control signals are also described in U.S. Pat. No. 6,111,368, issued Aug. 29, 2000, U.S. Pat. No. 5,399,940, issued Mar. 21, 1995, U.S. Pat. No. 5,017,837, issued May 21, 1991, all of which are assigned to Lutron. U.S. Pat. No. 6,111,368, for example, discloses an electronic dimming fluorescent lamp ballast that is controlled by a conventional A.C. phase control dimmer. U.S. Pat. No. 5,399,940 discloses a microprocessor-controlled "smart" dimmer that controls the light intensities of an array of LEDs in response to a phase control dimming voltage waveform. U.S. Pat. No. 5,017,837 discloses an analog A.C. phase control dimmer having an indicator LED, the intensity of which is controlled in response to a phase control dimming voltage waveform. The well-known CREDENZA® in-line lamp cord dimmer, manufactured by Lutron since 1977, also includes an indicator LED, the light intensity of which is controlled in response to a phase control dimming voltage waveform.

Applications for LED illumination systems are also shown in U.S. Pat. No. 7,309,965, issued Dec. 18, 2007, and U.S. Pat. No. 7,242,152, issued Jul. 10, 2007, both assigned to CK. U.S. Pat. No. 7,309,965 discloses smart lighting devices having processors, and networks comprising such smart lighting devices, sensors, and signal emitters. U.S. Pat. No. 7,242,152 discloses systems and methods for controlling a plurality of networked lighting devices in response to lighting control signals. Such systems are also used in the RADIORA® product, which has been sold since 1996 by Lutron.

In addition, there are known techniques for controlling current delivered to an LED light source. LED light sources are often referred to as "LED light engines." These LED light engines typically comprise a plurality of individual LED semiconductor structures, such as, for example, Gallium-Indium-Nitride (GaInN) LEDs. The individual LEDs may each produce light photons by electron-hole combination in the blue visible spectrum, which is converted to white light by a yellow phosphor filter.

It is known that the light output of an LED is proportional to the current flowing through it. It is also known that LEDs suffer from a phenomena known as "droop" in which the efficiency is reduced as the power is increased. For LEDs of the GaInN type (used for providing illumination), a typical load current is approximately 350 milliamps (mA) at a forward operating voltage of between three and four volts (V) which corresponds to approximately a one watt (W) power rating. At this power rating, these LEDs provide approximately 100 lumens per watt. This is significantly more efficient than other conventional light sources. For example, incandescent lamps typically provide 10 to 20 lumens per watt and fluorescent lamps, 60 to 90 lumens per watt. As discussed, LED light sources can provide larger ratios of lumens per watt at lower currents, thus avoiding the droop phenomena. Further, it is expected that, as technology improves, the efficiency of LED light sources will improve even at higher current levels than presently employed to provide higher light outputs per diode in an LED light engine.

LED light sources typically comprise a plurality of individual LEDs that may be arranged in both a series and parallel relationship. In other words, a plurality of LEDs may be arranged in a series string and a number of series strings may be arranged in parallel to achieve the desired light output. For example, five LEDs in a first series string each with a forward bias of approximately 3 volts (V) and each consuming approximately one watt of power (at 350 mA through the string) consume about 5 W. A second string of a series of five LEDs connected in parallel across the first string will result in a power consumption of 10 W with each string drawing 350 mA. Thus, an LED driver would need to supply 700 mA to the two strings of LEDs, and since each string has five LEDs, the output voltage provided by the LED driver would be about 15 volts. Additional strings of LEDs can be placed in parallel for additional light output, however, the LED driver must be operable to provide the necessary current. Alternatively, more LEDs can be placed in series on each sting, and as a result, the LED driver must also be operable to provide the necessary voltage (e.g., 18 volts for a series of six LEDs).

LED light sources are typically rated to be driven via one of two different control techniques: a current load control technique or a voltage load control technique. An LED light source that is rated for the current load control technique is also characterized by a rated current (e.g., 350 milliamps) to which the peak magnitude of the current through the LED light source should be regulated to ensure that the LED light source is illuminated to the appropriate intensity and color. In contrast, an LED light source that is rated for the voltage load control technique is characterized by a rated voltage (e.g., 15 volts) to which the voltage across the LED light source should be regulated to ensure proper operation of the LED light source. Typically, each string of LEDs in an LED light source rated for the voltage load control technique includes a current balance regulation element to ensure that each of the parallel legs has the same impedance so that the same current is drawn in each parallel string.

In addition, it is known that the light output of an LED light source can be dimmed. Different methods of dimming LEDs include a pulse-width modulation (PWM) technique and a constant current reduction (CCR) technique. Pulse-width modulation dimming can be used for LED light sources that are controlled in either a current or voltage load control mode. In pulse-width modulation dimming, a pulsed signal with a varying duty cycle is supplied to the LED light source. If an LED light source is being controlled using the current load control technique, the peak current supplied to the LED light source is kept constant during an on time of the duty cycle of the pulsed signal. However, as the duty cycle of the pulsed signal varies, the average current supplied to the LED light source also varies, thereby varying the intensity of the light output of the LED light source. If the LED light source is being controlled using the voltage load control technique, the voltage supplied to the LED light source is kept constant during the on time of the duty cycle of the pulsed signal in order to achieve the desired target voltage level, and the duty cycle of the load voltage is varied in order to adjust the intensity of the light output. Constant current reduction dimming is typically only used when an LED light source is being controlled using the current load control technique. In constant current reduction dimming, current is continuously provided to the LED light source, however, the DC magnitude of the current provided to the LED light source is varied to thus adjust the intensity of the light output.

There is a need for an LED driver that that is able to provide smooth, flicker-free dimming of the LED light source using constant current reduction dimming, particularly, in the event of changes in the desired intensity of the LED light source.

SUMMARY OF THE INVENTION

According to an embodiment of the present invention, a load control device for controlling the intensity of an lighting load comprises a power converter circuit operable to receive a rectified AC voltage and to generate a DC bus voltage, a load control circuit operable to receive the bus voltage and to control the magnitude of a load current conducted through the lighting load, and a controller operatively coupled to the power converter circuit and the load control circuit. The load control circuit comprises a controllable-impedance circuit adapted to be coupled in series with the lighting load. The controller adjusts the magnitude of the bus voltage to a target bus voltage, so as to control the magnitude of a controllable-impedance voltage generated across the controllable-impedance circuit. The controller generates a drive signal for controlling the controllable-impedance circuit to thus adjust the magnitude of the load current through the lighting load. The controller is operable to control both the magnitude of the load current and the magnitude of the controllable-impedance voltage to adjust the intensity of the lighting load. The controller controls the magnitude of the controllable-impedance voltage by simultaneously maintaining the magnitude of the drive signal constant and adjusting the bus voltage target.

In addition, an LED driver for controlling the intensity of an LED light source is also described herein. The LED driver comprises a power converter circuit operable to receive a rectified AC voltage and to generate a DC bus voltage, an LED drive circuit operable to receive the bus voltage and to control the magnitude of a load current conducted through the LED light source to thus control the intensity of the LED light source, and a controller operatively coupled to the power converter circuit and the LED drive circuit. The LED drive circuit comprises a controllable-impedance circuit adapted to be coupled in series with the LED light source. The controller adjusts the magnitude of the bus voltage to a target bus voltage, so as to control the magnitude of a regulator voltage generated across the controllable-impedance circuit. The controller generates a drive signal for controlling the controllable-impedance circuit to thus adjust the magnitude of the load current through the LED light source. If the magnitude of the load current is below a load current threshold and the magnitude of the regulator voltage is below a regulator voltage threshold, the controller maintains the magnitude of the drive signal constant and increases the target bus voltage, so as to increase the magnitude of the regulator voltage. According to another embodiment of the present invention, if the magnitude of the load current is above a load current threshold and the magnitude of the regulator voltage is above a regulator voltage threshold, the controller maintains the magnitude of the drive signal constant, and decreases the target bus voltage, so as to decrease the magnitude of the regulator voltage.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
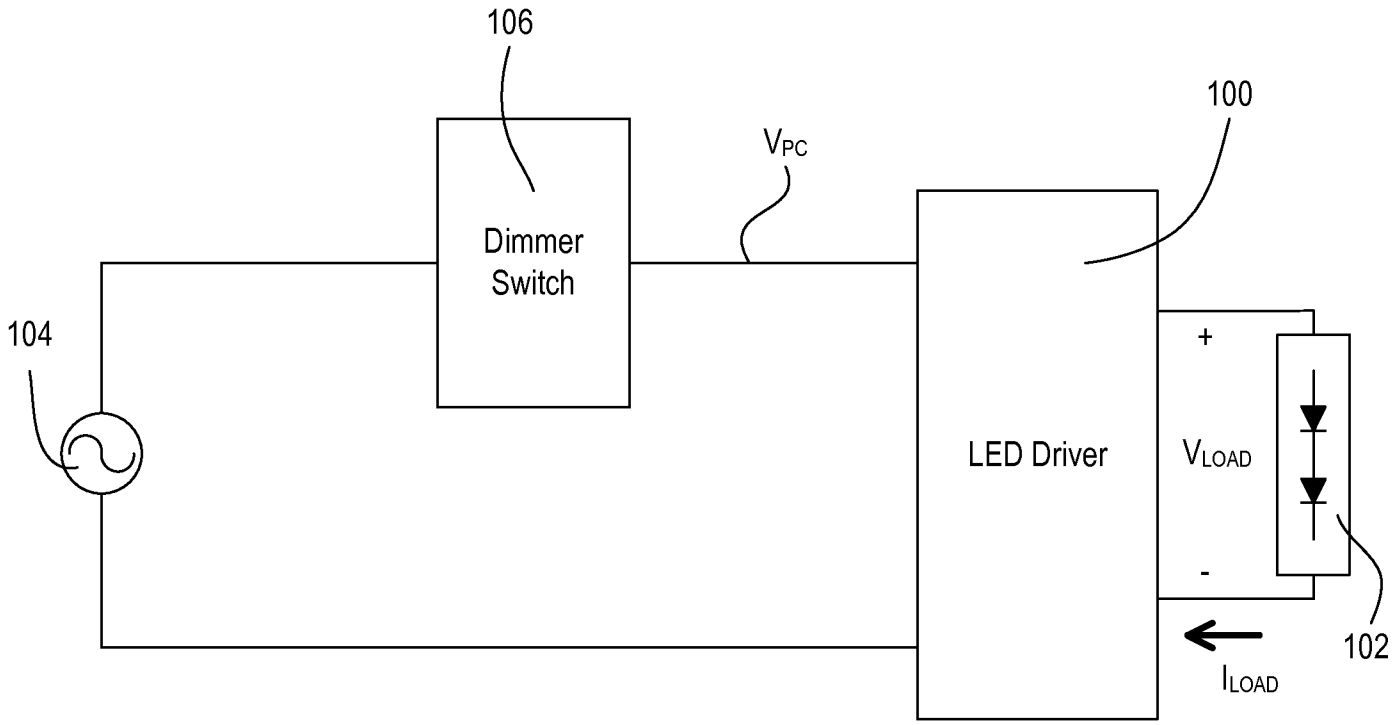
FIG. 1 is a simplified block diagram of a system including a light-emitting diode (LED) driver for controlling the intensity of an LED light source according to an embodiment of the present invention.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a simplified block diagram of a system including a light-emitting diode (LED) driver 100 for controlling the intensity of an LED light source 102 (e.g., an LED light engine) according to an embodiment of the present invention. The LED light source 102 is shown as a plurality of LEDs connected in series but may comprise a single LED or a plurality of LEDs connected in parallel or a suitable combination thereof, depending on the particular lighting system. In addition, the LED light source 102 may alternatively comprise one or more organic light-emitting diodes (OLEDs). The LED driver 100 is coupled to an alternating-current (AC) power source 104 via a dimmer switch 106. The dimmer switch 106 generates a phase-control signal $V_{PC}$ (e.g., a dimmed-hot voltage), which is provided to the LED driver 100. The dimmer switch 106 comprises a bidirectional semiconductor switch (not shown), such as, for example, a triac or two anti-series-connected field-effect transistors (FETs), coupled in series between the AC power source 104 and the LED driver 100. The dimmer switch 106 controls the bidirectional semiconductor switch to be conductive for a conduction period $T_{CON}$ each half-cycle of the AC power source 104 to generate the phase-control signal $V_{PC}$.

The LED driver 100 is operable to turn the LED light source 102 on and off in response to the conduction period $T_{CON}$ of the phase-control signal $V_{PC}$ received from the dimmer switch 106. In addition, the LED driver 100 is operable to adjust (i.e., dim) the intensity of the LED light source 102 to a target intensity $L_{TRGT}$, which may range across a dimming range of the LED light source, i.e., between a low-end intensity $L_{LE}$ (e.g., approximately 1%) and a high-end intensity $L_{HE}$ (e.g., approximately 100%) in response to the phase-control signal $V_{PC}$. The LED driver 100 is able to control both the magnitude of a load current $I_{LOAD}$ through the LED light source 102 and the magnitude of a load voltage $V_{LOAD}$ across the LED light source. Accordingly, the LED driver 100 controls at least one of the load voltage $V_{LOAD}$ across the LED light source 102 and the load current $I_{LOAD}$ through the LED light source to control the amount of power delivered to the LED light source depending upon a mode of operation of the LED driver (as will be described in greater detail below).

The LED driver 100 is adapted to work with a plurality of different LED light sources, which may be rated to operate using different load control techniques, different dimming techniques, and different magnitudes of load current and voltage. The LED driver 100 is operable to control the magnitude of the load current $I_{LOAD}$ through the LED light source 102 or the load voltage $V_{LOAD}$ across the LED light source using two different modes of operation: a current load control mode (i.e., for using the current load control technique) and a voltage load control mode (i.e., for using the voltage load control technique). The LED driver 100 may also be configured to adjust the magnitude to which the LED driver will control the load current $I_{LOAD}$ through the LED light source 102 in the current load control mode, or the magnitude to which the LED driver will control the load voltage $V_{LOAD}$ across the LED light source in the voltage load control mode. When operating in the current load control mode, the LED driver 100 is operable to control the intensity of the LED light source 102 using two different dimming modes: a PWM dimming mode (i.e., for using the PWM dimming technique) and a CCR dimming mode (i.e., for using the CCR dimming technique). When operating in the voltage load control mode, the LED driver 100 is only operable to adjust the amount of power delivered to the LED light source 102 using the PWM dimming technique.

Figure 2:
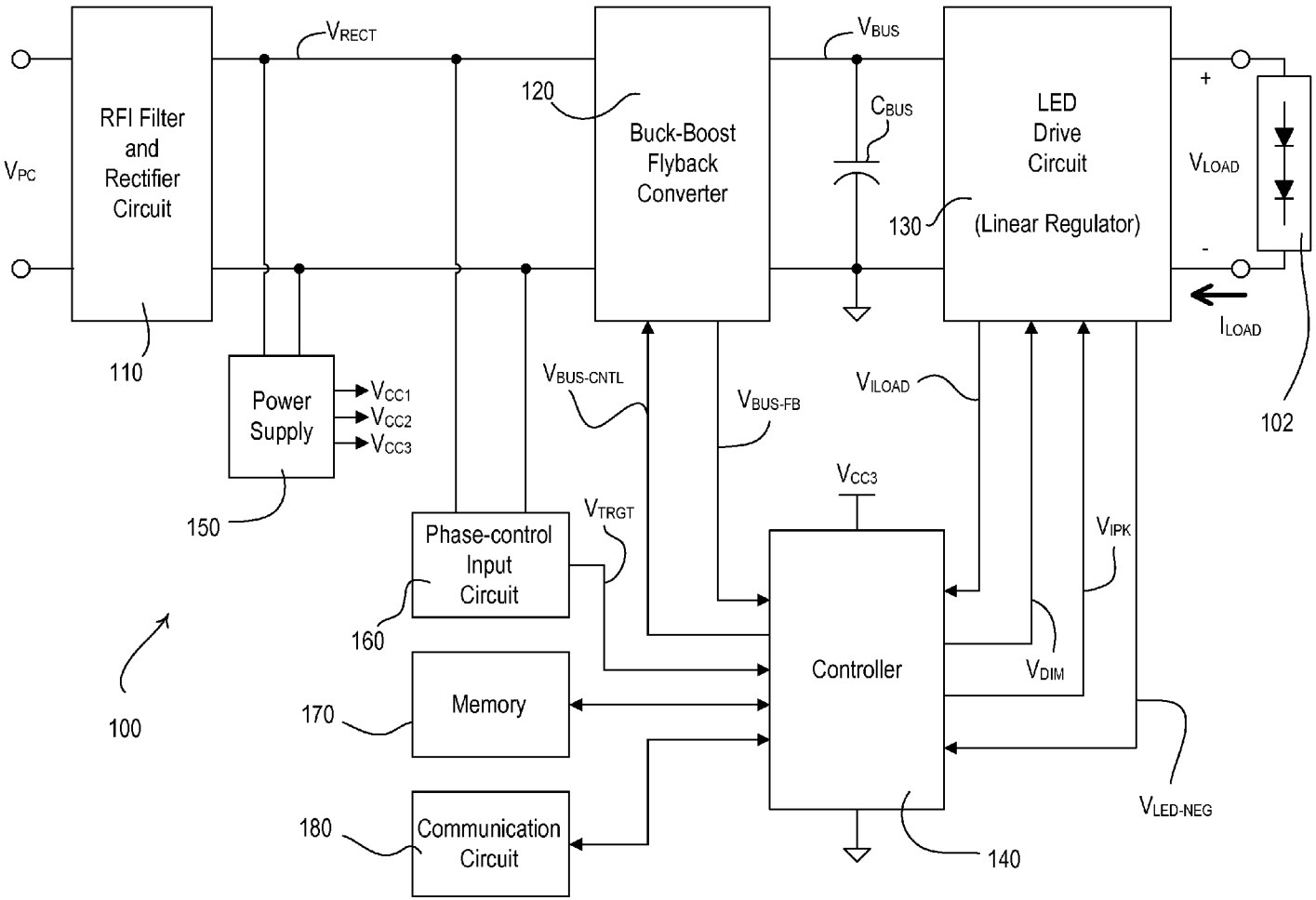
FIG. 2 is a simplified block diagram of the LED driver of FIG. 1.

FIG. 2 is a simplified block diagram of the LED driver 100 according to an embodiment of the present invention. The LED driver 100 comprises a radio-frequency (RFI) filter and rectifier circuit 110, which receives the phase-control signal $V_{PC}$ from the dimmer switch 106. The RFI filter and rectifier circuit 110 operates to minimize the noise provided on the AC power source 104 and to generate a rectified voltage $V_{RECT}$. The LED driver 100 further comprises a power converter, e.g., a buck-boost flyback converter 120, which receives the rectified voltage $V_{RECT}$ and generates a variable direct-current (DC) bus voltage $V_{BUS}$ across a bus capacitor $C_{BUS}$. The flyback converter 120 may alternatively comprise any suitable power converter circuit for generating an appropriate bus voltage, such as, for example, a boost converter, a buck converter, a single-ended primary-inductor converter (SEPIC), a Ćuk converter, or other suitable power converter circuit. The bus voltage $V_{BUS}$ may be characterized by some voltage ripple as the bus capacitor $C_{BUS}$ periodically charges and discharges. The flyback converter 120 may also provide electrical isolation between the AC power source 104 and the LED light source 102, and operate as a power factor correction (PFC) circuit to adjust the power factor of the LED driver 100 towards a power factor of one.

The LED driver 100 also comprises an LED drive circuit 130, which receives the bus voltage $V_{BUS}$ and controls the amount of power delivered to the LED light source 102 so as to control the intensity of the LED light source. The LED drive circuit 130 may comprise a controllable-impedance circuit, such as a linear regulator, as will be described in greater detail below. Alternatively, the LED drive circuit 130 could comprise a switching regulator, such as a buck converter. Examples of various embodiments of LED drive circuits are described in U.S. patent application Ser. No. 12/813,908, filed Jun. 11, 2010, entitled LOAD CONTROL DEVICE FOR A LIGHT-EMITTING DIODE LIGHT SOURCE, the entire disclosure of which is hereby incorporated by reference.

The LED driver 100 further comprises a controller 140 for controlling the operation of the flyback converter 120 and the LED drive circuit 130. The controller 140 may comprise, for example, a microcontroller or any other suitable processing device, such as, for example, a programmable logic device (PLD), a microprocessor, an application specific integrated circuit (ASIC), or a field-programmable gate array (FPGA). The LED driver 100 further comprises a power supply 150, which receives the rectified voltage $V_{RECT}$ and generates a plurality of direct-current (DC) supply voltages for powering the circuitry of the LED driver. Specifically, the power supply 150 generates a first non-isolated supply voltage $V_{CC1}$ (e.g., approximately 14 volts) for powering the control circuitry of the flyback converter 120, a second isolated supply voltage $V_{CC2}$ (e.g., approximately 9 volts) for powering the control circuitry of the LED drive circuit 130, and a third non-isolated supply voltage $V_{CC3}$ (e.g., approximately 5 volts) for powering the controller 140.

The controller 140 is coupled to a phase-control input circuit 160, which generates a target intensity control signal $V_{TRGT}$. The target intensity control signal $V_{TRGT}$ comprises, for example, a square-wave signal having a duty cycle $DC_{TRGT}$, which is dependent upon the conduction period $T_{CON}$ of the phase-control signal $V_{PC}$ received from the dimmer switch 106, and thus is representative of the target intensity $L_{TRGT}$ of the LED light source 102. Alternatively, the target intensity control signal $V_{TRGT}$ could comprise a DC voltage having a magnitude dependent upon the conduction period $T_{CON}$ of the phase-control signal $V_{PC}$, and thus representative of the target intensity $L_{TRGT}$ of the LED light source 102.

The controller 140 is also coupled to a memory 170 for storing the operational characteristics of the LED driver 100 (e.g., the load control mode, the dimming mode, and the magnitude of the rated load voltage or current). Finally, the LED driver 100 may also comprise a communication circuit 180, which may be coupled to, for example, a wired communication link or a wireless communication link, such as a radio-frequency (RF) communication link or an infrared (IR) communication link. The controller 140 may be operable to update the target intensity $L_{TRGT}$ of the LED light source 102 or the operational characteristics stored in the memory 170 in response to digital messages received via the communication circuit 180. For example, the LED driver 100 could alternatively be operable to receive a full conduction AC waveform directly from the AC power source 104 (i.e., not the phase-control signal $V_{PC}$ from the dimmer switch 106) and could simply determine the target intensity $L_{TRGT}$ for the LED light source 102 from the digital messages received via the communication circuit 180.

As previously mentioned, the controller 140 manages the operation of the flyback converter 120 and the LED drive circuit 130 to control the intensity of the LED light source 102. The controller 140 receives a bus voltage feedback signal $V_{BUS-FB}$, which is representative of the magnitude of the bus voltage $V_{BUS}$, from the flyback converter 120. The controller 140 provides a bus voltage control signal $V_{BUS-CNTL}$ to the flyback converter 120 for controlling the magnitude of the bus voltage $V_{BUS}$ to a target bus voltage $V_{BUS-TRGT}$ (e.g., from approximately 8 volts to 60 volts). When operating in the current load control mode, the LED drive circuit 130 controls a peak magnitude $I_{PK}$ of the load current $I_{LOAD}$ conducted through the LED light source 102 between a minimum load current $I_{LOAD-MIN}$ and a maximum load current $I_{LOAD-MAX}$ in response to a peak current control signal $V_{IPK}$ (provided by the controller 140. The controller 140 receives a load current feedback signal $V_{ILOAD}$, which is representative of an average magnitude $I_{AVE}$ of the load current $I_{LOAD}$ flowing through the LED light source 102. The controller 140 also receives a regulator voltage feedback signal $V_{REG-FB}$ that is representative of the magnitude of a regulator voltage $V_{REG}$ (i.e., a controllable-impedance voltage) across the linear regulator of the LED drive circuit 130 as will be described in greater detail below.

The controller 140 is operable to control the LED drive circuit 130, so as to control the amount of power delivered to the LED light source 102 using the two different modes of operation (i.e., the current load control mode and the voltage load control mode). During the current load control mode, the LED drive circuit 130 regulates the peak magnitude $I_{PK}$ of the load current $I_{LOAD}$ through the LED light source 102 to control the average magnitude $I_{AVE}$ to a target load current $I_{TRGT}$ in response to the load current feedback signal $V_{ILOAD}$ (i.e., using closed loop control). The target load current $I_{TRGT}$ may be stored in the memory 170 and may be programmed to be any specific magnitude depending upon the LED light source 102.

To control the intensity of the LED light source 102 during the current load control mode, the controller 140 is operable to control the LED drive circuit 130 to adjust the amount of power delivered to the LED light source 102 using both of the dimming techniques (i.e., the PWM dimming technique and the CCR dimming technique). Using the PWM dimming technique, the controller 140 controls the peak magnitude $I_{PK}$ of the load current $I_{LOAD}$ through the LED light source 102 to the target load current $I_{TRGT}$ and pulse-width modulates the load current $I_{LOAD}$ to dim the LED light source 102 and achieve the target load current $I_{TRGT}$. Specifically, the LED drive circuit 130 controls a duty cycle $DC_{ILOAD}$ of the load current $I_{LOAD}$ in response to a duty cycle $DC_{DIM}$ of a dimming control signal $V_{DIM}$ provided by the controller 140. Accordingly, the intensity of the LED light source 102 is dependent upon the duty cycle $DC_{ILOAD}$ of the pulse-width modulated load current $I_{LOAD}$. Using the CCR technique, the controller 140 does not pulse-width modulate the load current $I_{LOAD}$, but instead adjusts the magnitude of the target load current $I_{TRGT}$ so as to adjust the average magnitude $I_{AVE}$ of the load current $I_{LOAD}$ through the LED light source 102 (which is equal to the peak magnitude $I_{PK}$ of the load current $I_{LOAD}$ in the CCR dimming mode).

During the voltage load control mode, the LED drive circuit 130 regulates the DC voltage of the load voltage $V_{LOAD}$ across the LED light source 102 to a target load voltage $V_{TRGT}$. The target load voltage $V_{TRGT}$ may be stored in the memory 170 and may be programmed to be any specific magnitude depending upon the LED light source 102. The controller 140 is operable to dim the LED light source 102 using only the PWM dimming technique during the voltage load control mode. Specifically, the controller 140 adjusts a duty cycle $DC_{VLOAD}$ of the load voltage $V_{LOAD}$ to dim the LED light source 102. An example of a configuration procedure for the LED driver 100 is described in greater detail in U.S. patent application Ser. No. 12/813,989, filed Jun. 11, 2010, entitled CONFIGURABLE LOAD CONTROL DEVICE FOR LIGHT-EMITTING DIODE LIGHT SOURCES, the entire disclosure of which is hereby incorporated by reference.

Figure 3:
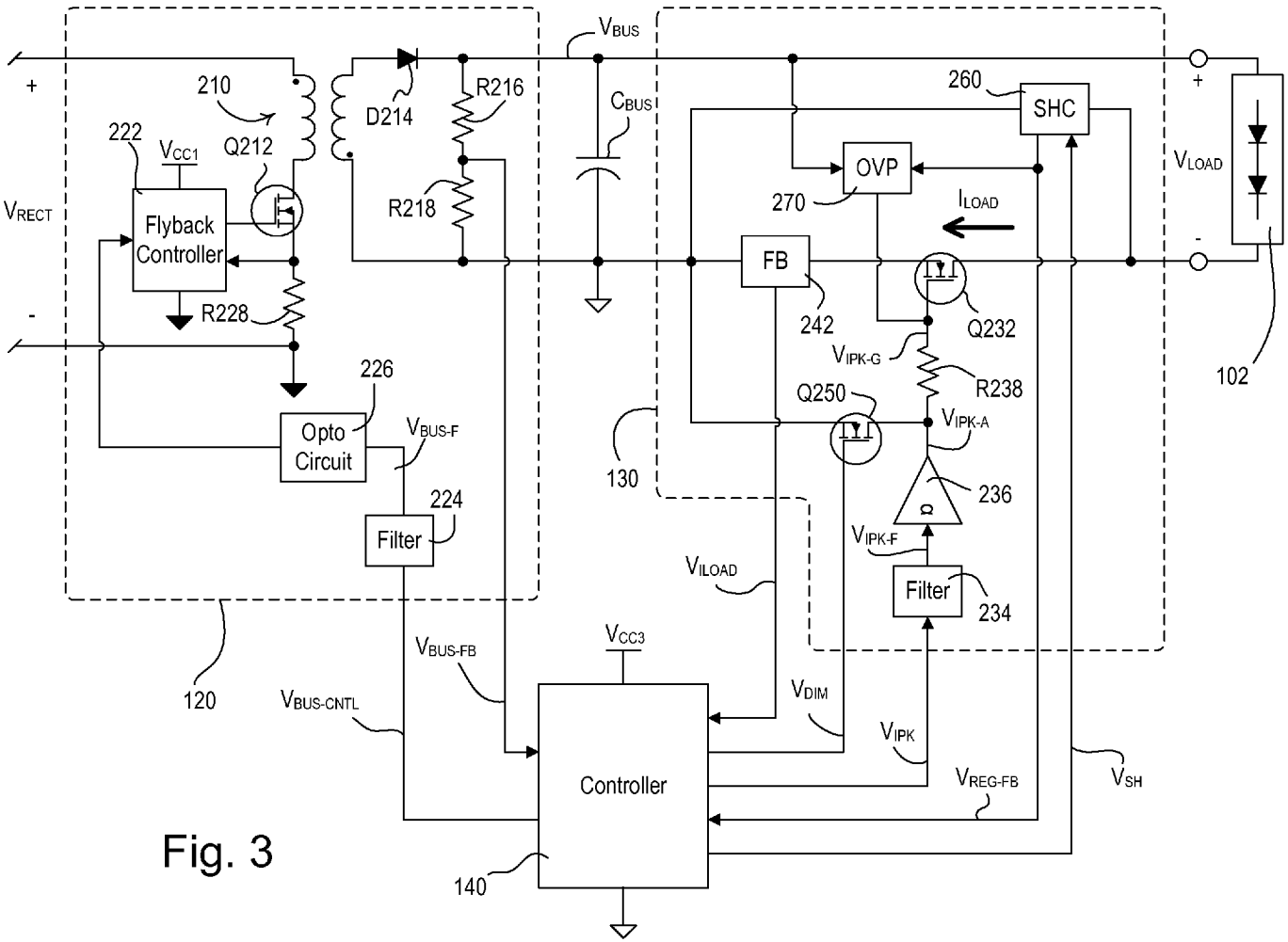
FIG. 3 is a simplified schematic diagram of a flyback converter and an LED drive circuit of the LED driver of FIG. 1.

FIG. 3 is a simplified schematic diagram of the flyback converter 120 and the LED drive circuit 130. The flyback converter 120 comprises a flyback transformer 210 having a primary winding coupled in series with a flyback switching transistor, e.g., a field-effect transistor (FET) Q212 or other suitable semiconductor switch. The secondary winding of the flyback transformer 210 is coupled to the bus capacitor $C_{BUS}$ via a diode D214. The bus voltage feedback signal $V_{BUS-FB}$ is generated by a voltage divider comprising two resistors R216, R218 coupled across the bus capacitor $C_{BUS}$. A flyback control circuit 222 receives the bus voltage control signal $V_{BUS-CNTL}$ from the controller 140 via a filter circuit 224 and an optocoupler circuit 226, which provides electrical isolation between the flyback converter 120 and the controller 140. The flyback control circuit 222 may comprise, for example, part number TDA4863, manufactured by Infineon Technologies. The filter circuit 224 may comprise, for example, a two-stage resistor-capacitor (RC) filter, for generating a filtered bus voltage control signal $V_{BUS-CNTL}$, which has a DC magnitude dependent upon a duty cycle $DC_{BUS}$ of the bus voltage control signal $V_{BUS-CNTL}$. The flyback control circuit 222 also receives a control signal representative of the current through the FET Q212 from a feedback resistor R228, which is coupled in series with the FET.

The flyback control circuit 222 controls the FET Q212 to selectively conduct current through the flyback transformer 210 to thus generate the bus voltage $V_{BUS}$. The flyback control circuit 222 is operable to render the FET Q212 conductive and non-conductive at a high frequency (e.g., approximately 150 kHz or less) to thus control the magnitude of the bus voltage $V_{BUS}$ in response to the DC magnitude of the filtered bus voltage control signal $V_{BUS-F}$ and the magnitude of the current through the FET Q212. Specifically, the controller 140 increases the duty cycle $DC_{BUS}$ of the bus voltage control signal $V_{BUS-CNTL}$, such that the DC magnitude of the filter bus voltage control signal $V_{BUS-F}$ increases in order to decrease the magnitude of the bus voltage $V_{BUS}$. The controller 140 decreases the duty cycle $DC_{BUS}$ of the bus voltage control signal $V_{BUS-CNTL}$ to increase the magnitude of the bus voltage $V_{BUS}$. The filter circuit 224 provides a simple digital-to-analog conversion for the controller 140 (i.e., from the duty cycle $DC_{BUS}$ of the bus voltage control signal $V_{BUS-CNTL}$ to the DC magnitude of the filtered bus voltage control signal $V_{BUS-CNTL}$). Alternatively, the controller 140 could comprise a digital-to-analog converter (DAC) for directly generating the bus voltage control signal $V_{BUS-CNTL}$ having an appropriate DC magnitude for controlling the magnitude of the bus voltage $V_{BUS}$.

Figure 4:
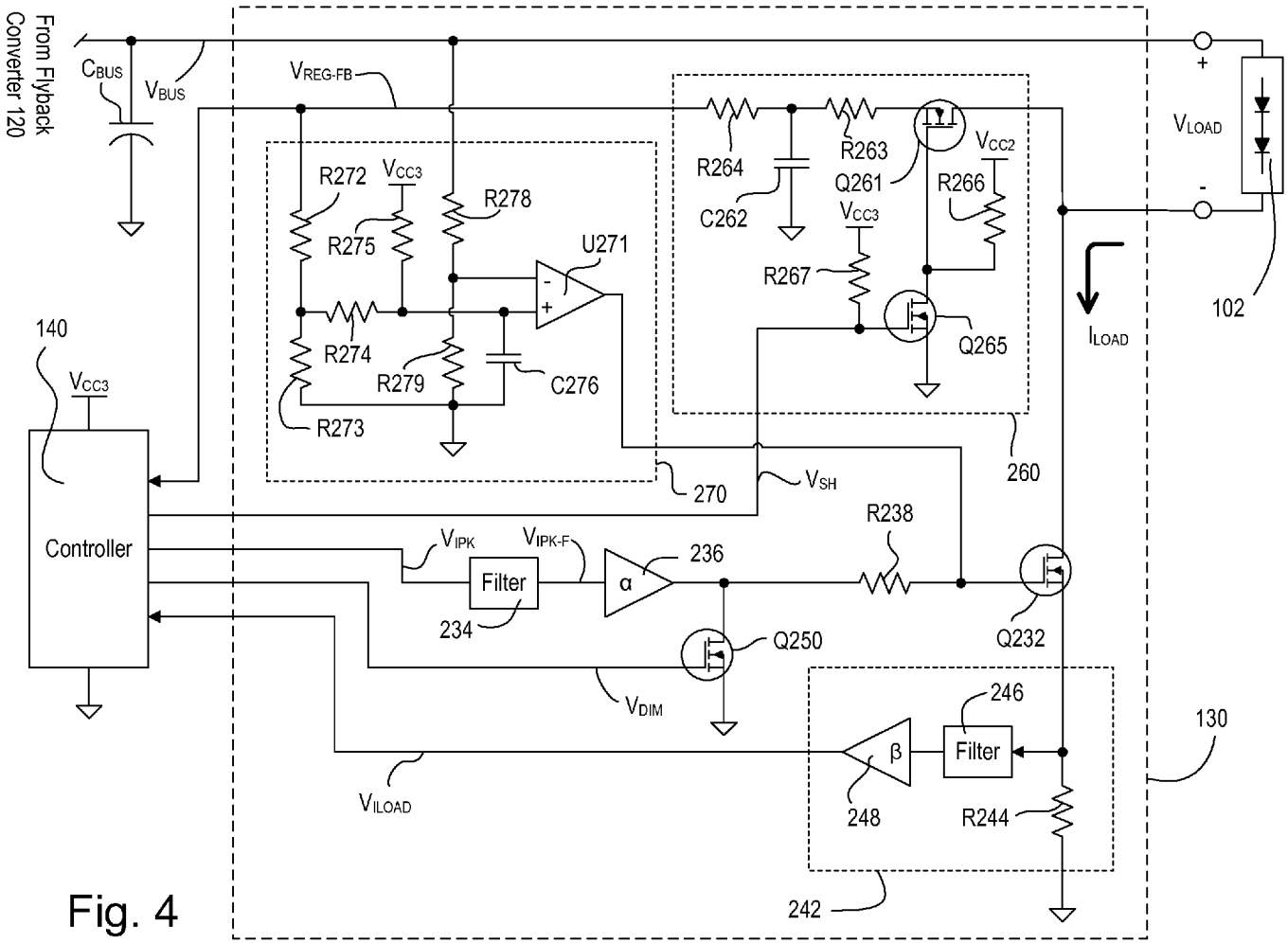
FIG. 4 is a simplified schematic diagram showing the LED drive circuit of FIG. 3 in greater detail.

FIG. 4 is a simplified schematic diagram showing the LED drive circuit 130 in greater detail. As previously mentioned, the LED drive circuit 130 comprises a linear regulator (i.e., a controllable-impedance circuit) including a power semiconductor switch, e.g., a regulation field-effect transistor (FET) Q232, coupled in series with the LED light source 102 for conducting the load current $I_{LOAD}$. The regulation FET Q232 could alternatively comprise a bipolar junction transistor (BJT), an insulated-gate bipolar transistor (IGBT), or any suitable transistor. The peak current control signal $V_{IPK}$ provided by the controller 140 is coupled to the gate of the regulation FET Q232 through a filter circuit 234, an amplifier circuit 236, and a gate resistor R238. The controller 140 is operable to control a duty cycle $DC_{IPK}$ of the peak current control signal $V_{IPK}$ to control the peak magnitude $I_{PK}$ of the load current $I_{LOAD}$ conducted through the LED light source 102 to the target load current $I_{TRGT}$. The filter circuit 234 (e.g., a two-stage RC filter) provides digital-to-analog conversion for the controller 140 by generating a filtered peak current control signal $V_{IPK-F}$, which has a DC magnitude dependent upon the duty cycle $DC_{IPK}$ of the peak current control signal $V_{IPK}$, and is thus representative of the magnitude of the target load current $I_{TRGT}$. Alternatively, the controller 140 could comprise a DAC for directly generating the peak current control signal $V_{IPK}$ having an appropriate DC magnitude for controlling the peak magnitude $I_{PK}$ of the load current $I_{LOAD}$. The amplifier circuit 236 generates an amplified peak current control signal $V_{IPK-A}$, which is provided to the gate of the regulation transistor Q232 through the resistor R238, such that a drive signal at the gate of the regulation transistor Q232, e.g., a gate voltage $V_{IPK-G}$, has a magnitude dependent upon the target load current $I_{TRGT}$. The amplifier circuit 236 may comprise a standard non-inverting operational amplifier circuit having, for example, a gain $\alpha$ of approximately three.

A feedback circuit 242 comprising a feedback resistor 8244 is coupled in series with the regulation FET Q232, such that the voltage generated across the feedback resistor is representative of the magnitude of the load current $I_{LOAD}$. For example, the feedback resistor R244 may have a resistance of approximately 0.0375Ω. The feedback circuit 242 further comprises a filter circuit 246 (e.g., a two-stage RC filter) coupled between the feedback resistor 8244 and an amplifier circuit 248 (e.g., a non-inverting operational amplifier circuit having a gain $\beta$ of approximately 20). Alternatively, the amplifier circuit 248 could have a variable gain, which could be controlled by the controller 140 and could range between approximately 1 and 1000. The amplifier circuit 248 generates the load current feedback signal $V_{ILOAD}$, which is provided to the controller 140 and is representative of an average magnitude $I_{AVE}$ of the load current $I_{LOAD}$, e.g., $$I_{AVE}=V_{ILOAD}/(\beta \cdot R_{FB}), \quad \text{(Equation 1)}$$

wherein $R_{FB}$ is the resistance of the feedback resistor R244. Examples of other feedback circuits for the LED drive circuit 130 are described in greater detail in U.S. patent application Ser. No. 12/814,026, filed Jun. 11, 2010, entitled CLOSED-LOOP LOAD CONTROL CIRCUIT HAVING A WIDE OUTPUT RANGE, the entire disclosure of which is hereby incorporated by reference.

When operating in the current load control mode, the controller 140 controls the regulation FET Q232 to operate in the linear region, such that the peak magnitude $I_{PK}$ of the load current $I_{LOAD}$ is dependent upon the DC magnitude of the gate voltage $V_{IPK-G}$ at the gate of the regulation transistor Q232. In other words, the regulation FET Q232 provides a controllable-impedance in series with the LED light source 102. If the magnitude of the regulator voltage $V_{REG}$ drops too low, the regulation FET Q232 may be driven into the saturation region, such that the regulation FET Q232 becomes fully conductive and the controller 140 is no longer able to control the peak magnitude $I_{PK}$ of the load current $I_{LOAD}$. Therefore, the controller 140 adjusts the magnitude of the bus voltage $V_{BUS}$ to prevent the magnitude of the regulator voltage $V_{REG}$ from dropping below a minimum regulator voltage threshold $V_{REG-MIN}$ (e.g., approximately 0.4 volts). In addition, the controller 140 is also operable to adjust the magnitude of the bus voltage $V_{BUS}$ to control the magnitude of the regulator voltage $V_{REG}$ to be less a maximum regulator voltage threshold $V_{REG-MAX}$ (e.g., approximately 0.6 volts) to prevent the power dissipated in regulation FET Q232 from becoming too large, thus increasing the total efficiency of the LED driver 100. Since the regulator voltage $V_{REG}$ may have some ripple (due to the ripple of the bus voltage $V_{BUS}$), the controller 140 is operable to determine the minimum value of the regulator voltage $V_{REG}$ during a period of time and to compare this minimum value of the regulator voltage $V_{REG}$ to the regulator voltage threshold $V_{REG-MIN}$ and the maximum regulator voltage threshold $V_{REG-MAX}$.

When operating in the voltage load control mode, the controller 140 is operable to drive the regulation FET Q232 into the saturation region, such that the magnitude of the load voltage $V_{LOAD}$ is approximately equal to the magnitude of the bus voltage $V_{BUS}$ (minus the small voltage drops due to the on-state drain-source resistance $R_{DS-ON}$ of the FET regulation Q232 and the resistance of the feedback resistor R244).

The LED drive circuit 130 also comprises a dimming FET Q250, which is coupled between the gate of the regulation FET Q232 and circuit common. The dimming control signal $V_{DIM}$ from the controller 140 is provided to the gate of the dimming FET Q250. When the dimming FET Q250 is rendered conductive, the regulation FET Q232 is rendered non-conductive, and when the dimming FET Q250 is rendered non-conductive, the regulation FET Q232 is rendered conductive. While using the PWM dimming technique during the current load control mode, the controller 140 adjusts the duty cycle $DC_{DIM}$ of the dimming control signal $V_{DIM}$ (to adjust the length of an on time $t_{ON}$ that the regulation FET Q232 is conductive) to thus control the when the regulation FET conducts the load current $I_{LOAD}$ and thus the intensity of the LED light source 102. For example, the controller 140 may generate the dimming control signal $V_{DIM}$ using a constant PWM frequency $f_{PWM}$ (e.g., approximately 500 Hz), such that the on time $t_{ON}$ of the dimming control signal $V_{DIM}$ is dependent upon the duty cycle $DC_{DIM}$, i.e., $$t_{ON}=(1-DC_{DIM})/f_{PWM}. \quad \text{(Equation 2)}$$

As the duty cycle $DC_{DIM}$ of the dimming control signal $V_{DIM}$ increases, the duty cycle $DC_{ITRGT}$, $DC_{VTRGT}$ of the corresponding load current $I_{LOAD}$ or load voltage $V_{LOAD}$ decreases, and vice versa.

When using the PWM dimming technique in the current load control mode, the controller 140 is operable to control the peak magnitude $I_{PK}$ of the load current $I_{LOAD}$ in response to the load current feedback signal $V_{ILOAD}$ to maintain the average magnitude $I_{AVE}$ of the load current $I_{LOAD}$ constant (i.e., at the target lamp current $L_{TRGT}$). Alternatively, the controller 140 could be operable to calculate the peak magnitude $I_{PK}$ of the load current $I_{LOAD}$ from the load current feedback signal $V_{ILOAD}$ (which is representative of the average magnitude $I_{AVE}$ of the load current $I_{LOAD}$) and the duty cycle $DC_{DIM}$ of the dimming control signal $V_{DIM}$, i.e., $$I_{PK}=I_{AVE}/(1-DC_{DIM}). \quad \text{(Equation 3)}$$

When using the CCR dimming technique during the current load control mode, the controller 140 maintains the duty cycle $DC_{DIM}$ of the dimming control signal $V_{DIM}$ at a high-end dimming duty cycle $DC_{HE}$ (e.g., approximately 0%, such that the FET Q232 is always conductive) and adjusts the target load current $I_{TRGT}$ (via the duty cycle $DC_{IPK}$ of the peak current control signal $V_{IPK}$) to control the intensity of the LED light source 102.

The regulator voltage feedback signal $V_{REG-FB}$ is generated by a sample and hold circuit 260 of the LED drive circuit 130 and is representative of the regulator voltage $V_{REG}$ generated across the series combination of the regulation FET Q232 and the feedback resistor R244 when the regulation FET is conducting the load current $I_{LOAD}$. The sample and hold circuit 260 comprises a sampling transistor, e.g., a FET Q261, that is coupled to the junction of the LED light source 102 and the regulation FET Q232. When the FET Q261 is rendered conductive, a capacitor C262 (e.g., having a capacitance of approximately 1 μF) charges to approximately the magnitude of the regulator voltage $V_{REG}$ through a resistor R263 (e.g., having a resistance of approximately 10Ω). The capacitor C262 is coupled to the controller 140 through a resistor R264 (e.g., having a resistance of approximately 12.1 kΩ) for providing the regulator voltage feedback signal $V_{REG-FB}$ to the controller. The gate of the FET Q261 is coupled to circuit common through a second FET Q265 and to the second isolated supply voltage $V_{CC2}$ through a resistor R266 (e.g., having a resistance of approximately 20 kΩ). The gate of the second FET Q265 is coupled to the third non-isolated supply voltage $V_{CC3}$ through a resistor C267 (e.g., having a resistance of approximately 10 kΩ).

The controller 140 generates a sample and hold control signal $V_{SH}$ that is operatively coupled to the control input (i.e., the gate) of the second FET Q265 sample and hold circuit 260 for rendering the FET Q261 conductive and non-conductive to thus controllably charge the capacitor C262 to the magnitude of the regulator voltage $V_{REG}$. Specifically, when using the PWM dimming mode, the controller 140 is operable to render the FET Q261 conductive during each on time $t_{ON}$ of the dimming control signal $V_{DIM}$ (i.e., when the dimming FET Q250 is non-conductive and the regulation FET Q232 is conductive), such that the regulator voltage feedback signal $V_{REG-FB}$ is representative of the magnitude of the regulator voltage $V_{REG}$ when the regulation FET is conducting the load current $I_{LOAD}$. Alternatively, when the controller 140 is using the CCR dimming mode, the FET Q261 is rendered conductive at all times.

The LED drive circuit 130 also comprises an overvoltage protection circuit 270 that is responsive to the magnitude of the bus voltage $V_{BUS}$ and the magnitude of the regulator feedback voltage $V_{REG-FB}$. The difference between the magnitudes of the bus voltage $V_{BUS}$ and the regulator feedback voltage $V_{REG-FB}$ is representative of the magnitude of the load voltage $V_{LOAD}$ across the LED light source 102. The overvoltage protection circuit 270 comprises a comparator U271 having an output coupled to the gate of the regulation FET Q232 for rendering the FET non-conductive if the load voltage $V_{LOAD}$ exceeds an overvoltage threshold. The overvoltage protection circuit 270 also comprises a resistor divider that receives the regulator feedback voltage $V_{REG-FB}$ and has two resistors R272, R273. The junction of the resistors R272, R273 is coupled to the non-inverting input of the comparator U271 through a resistor R274. The non-inverting input is also coupled to the third non-isolated supply voltage $V_{CC3}$ through a resistor R275, and to circuit common through a filtering capacitor C276 (e.g., having a capacitance of approximately 10 μF). Another resistor divider is coupled between the bus voltage $V_{BUS}$ and circuit common, and comprises two resistors R278, R279. The junction of the resistors R278, R279 is coupled to the inverting input of the comparator U271, such that the magnitude of the voltage at the non-inverting input of the comparator is responsive to the regulator feedback voltage $V_{REG-FB}$ and the magnitude of the voltage at the inverting input is responsive to the bus voltage $V_{BUS}$. The comparator U271 operates to render the regulation FET Q232 non-conductive if the difference between the magnitudes of the bus voltage $V_{BUS}$ and the regulator feedback voltage $V_{REG-FB}$ exceeds the overvoltage threshold.

The resistances of the resistors R272, R273, R274, R275, R278, R279 of the overvoltage protection circuit 270 are chosen such that the voltage at the non-inverting input of the comparator U271 is proportional to the magnitude of the regulator feedback voltage $V_{REG-FB}$. Accordingly, the magnitude of the bus voltage $V_{BUS}$ that is required to cause the voltage at the inverting input of the comparator U271 to exceed the voltage at the non-inverting input increases in proportional to the magnitude of the regulator feedback voltage $V_{REG-FB}$, such that the overvoltage threshold that the load voltage $V_{LOAD}$ must exceed to render the regulation FET Q232 non-conductive remains approximately constant as the magnitude of the regulator feedback voltage $V_{REG-FB}$ changes. In addition, the resistances of the resistors R275, R274 must be much greater than the resistances of the resistors 8272, 8273 to avoid loading the regulator feedback voltage $V_{REG-FB}$.

Figure 5:
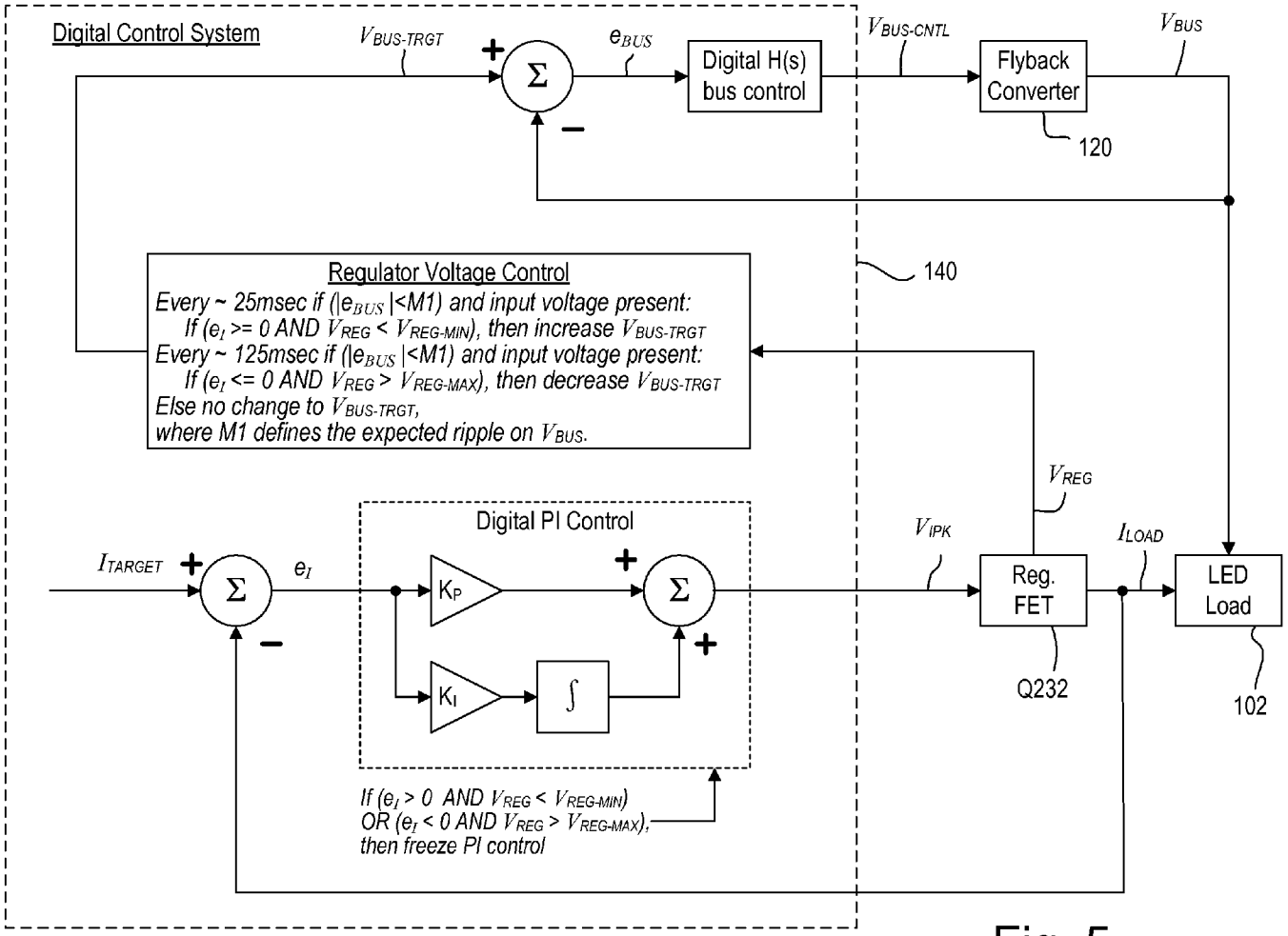
FIG. 5 is a simplified control diagram of the LED driver of FIG. 1.

FIG. 5 is a simplified control diagram of the LED driver 100. The controller 140 implements three control loops for control of the magnitude of the bus voltage $V_{BUS}$, the peak magnitude $I_{PK}$ of the load current $I_{LOAD}$, and the target bus voltage $V_{BUS-TRGT}$ (to thus control the magnitude of the regulator voltage $V_{REG}$). The controller 140 is operable to control the bus voltage control signal $V_{BUS-CNTL}$ to thus control the magnitude of the bus voltage $V_{BUS}$ to the target bus voltage $V_{BUS-TRGT}$ using a software implementation of a transfer function H(s) that has an analog representation of, for example, $$H(s) = \frac{K \cdot (s + 11)}{s \cdot (s + 100)}, \quad \text{(Equation 4)}$$

where K is a compensator gain, which may be adjusted to provide the correct compensation of the PFC control loop of the flyback control circuit 222 as is well known in the art. Specifically, the controller 140 adjusts the magnitude of the bus voltage $V_{BUS}$ in response to the product of the transfer function and a bus voltage error $e_{BUS}$ between the target bus voltage $V_{BUS-TRGT}$ and the actual bus voltage $V_{BUS}$. The controller 140 freezes the control of the bus voltage $V_{BUS}$ by maintaining the duty cycle $DC_{BUS}$ of the bus voltage control signal $V_{BUS-CNTL}$ constant in the event of a line voltage dropout.

Under stable conditions, the controller 140 is operable to adjust the duty cycle $DC_{IPK}$ of the peak current control signal $V_{IPK}$ to control the average magnitude $I_{AVE}$ of the load current $I_{LOAD}$ to be equal to the target load current $I_{TRGT}$. Specifically, the controller 140 adjusts the duty cycle $DC_{IPK}$ of the peak current control signal $V_{IPK}$ in response to a current error $e_I$ between the actual peak magnitude $I_{PK}$ of the load current $I_{LOAD}$ and the target load current $I_{TRGT}$ using a loop-tuned proportional-integral (PI) control algorithm. However, in the event of transient changes in the conduction period $T_{CON}$ of the phase-control signal $V_{PC}$ and thus the target intensity $L_{TRGT}$ of the LED light source 102, the controller 140 is able to freeze (i.e., lock) the PI control algorithm (to thus maintain the duty cycle $DC_{IPK}$ of the peak current control signal $V_{IPK}$ constant) and to quickly control the target bus voltage $V_{BUS-TRGT}$ to thus adjust the magnitude of the regulator voltage $V_{REG}$ and the peak magnitude $I_{PK}$ of the load current $I_{LOAD}$. The controller 140 will only adjust the target bus voltage $V_{BUS-TRGT}$ if line voltage (i.e., the phase-control signal $V_{PC}$) is present and the magnitude of the bus voltage $V_{BUS}$ is within predetermined limits with respect to the target bus voltage $V_{BUS-TRGT}$ (indicating that the bus voltage has settled to a steady state value after a previous change in the target bus voltage $V_{BUS-TRGT}$) to prevent windup of the flyback control circuit 222 or overshooting of the bus voltage $V_{BUS}$.

If the magnitude of the regulator voltage $V_{REG}$ is less than the minimum regulator voltage threshold $V_{REG-MIN}$ and the average magnitude $I_{AVE}$ of the load current $I_{LOAD}$ needs to be increased to be equal to the target current $I_{TRGT}$, the regulator voltage $V_{REG}$ may be in danger of collapsing towards zero volts, such that the controller 140 will no longer be able to control the peak magnitude $I_{PK}$ of the load current $I_{LOAD}$. Therefore, if the average magnitude $I_{AVE}$ of the load current $I_{LOAD}$ is less than the target load current $I_{TRGT}$ and the magnitude of the regulator voltage $V_{REG}$ is less than the minimum regulator voltage threshold $V_{REG-MIN}$, the controller 140 maintains the duty cycle $DC_{IPK}$ of the peak current control signal $V_{IPK}$ constant, and increases the target bus voltage $V_{BUS-TRGT}$ by a predetermined amount $\Delta V_{BUS+}$ (e.g., approximately 2 V) to quickly increase the magnitude of the regulator voltage $V_{REG}$ and prevent the regulation FET Q232 from being driven into full conduction. The controller 140 adjusts the target bus voltage $V_{BUS-TRGT}$ such that the target bus voltage $V_{BUS-TRGT}$ is only adjusted, for example, every 25 msec when the controller 140 is increasing the target bus voltage $V_{BUS-TRGT}$.

Similarly, if the average magnitude $I_{AVE}$ of the load current $I_{LOAD}$ is greater than the target load current $I_{TRGT}$ and the magnitude of the regulator voltage $V_{REG}$ is greater than the maximum regulator voltage threshold $V_{REG-MAX}$, the controller 140 is operable to freeze the PI control algorithm by maintaining the duty cycle $DC_{IPK}$ of the peak current control signal $V_{IPK}$ constant, and decrease the target bus voltage $V_{BUS-TRGT}$ by a predetermined amount $\Delta V_{BUS-}$ (e.g., approximately 0.1 V) to prevent the regulation FET Q232 from dissipating too much power. When the controller 140 is decreasing the target bus voltage $V_{BUS-TRGT}$, the controller 140 controls the target bus voltage $V_{BUS-TRGT}$ such that the target bus voltage $V_{BUS-TRGT}$ is only adjusted, for example, every 125 msec, which prevents undershoot of the magnitude of the bus voltage $V_{BUS}$.

When the LED driver 100 is operating in the PWM dimming mode, the controller 140 uses a predetermined constant value (e.g., approximately 0.6 volts) for the maximum regulator voltage threshold $V_{REG-MAX}$. However, when the LED driver 100 is operating in the CCR dimming mode, changes in the target bus voltage $V_{BUS-TRGT}$ (caused by changes in the load voltage $V_{LOAD}$) may result in modifications in the peak magnitude $I_{PK}$ of the load current $I_{LOAD}$, which may cause flickering in the LED light source 102. Therefore, the controller 140 is operable to adjust the maximum regulator voltage threshold $V_{REG-MAX}$ in response to the average magnitude $I_{AVE}$ of the load current $I_{LOAD}$, such that the power dissipated in the regulation FET Q232 is limited to a predetermined constant maximum power $P_{FET-MAX}$ (e.g., approximately 2-3 W), i.e., $$V_{REG-MAX} = P_{FET-MAX}/I_{AVE}, \quad \text{(Equation 5)}$$

when operating in the CCR dimming mode. Accordingly, the controller 140 will adjust the target bus voltage $V_{BUS-TRGT}$ less often (thus limiting flickering in the LED light source 102), while still limiting the power dissipation in the regulation FET Q232.

Accordingly, the controller 140 is operable to control adjust the intensity of the LED light source 102 by controlling both the peak magnitude $I_{PK}$ of the load current $I_{LOAD}$ and the magnitude of the bus voltage $V_{BUS}$, where control of the peak magnitude $I_{PK}$ of the load current $I_{LOAD}$ may be frozen in order to control the magnitude of the bus voltage $V_{BUS}$, and control of the magnitude of the bus voltage $V_{BUS}$ may be frozen in order to control the peak magnitude $I_{PK}$ of the load current $I_{LOAD}$. Specifically, the controller 140 freezes control of the peak magnitude $I_{PK}$ of the load current $I_{LOAD}$ and adjusts the target bus voltage $V_{BUS-TRGT}$ if the average magnitude $I_{AVE}$ of the load current $I_{LOAD}$ is less than the target load current $I_{TRGT}$ and the magnitude of the regulator voltage $V_{REG}$ is less than the minimum regulator voltage threshold $V_{REG-MIN}$, or if the average magnitude $I_{AVE}$ of the load current $I_{LOAD}$ is greater than the target load current $I_{TRGT}$ and the magnitude of the regulator voltage $V_{REG}$ is greater than the maximum regulator voltage threshold $V_{REG-MAX}$. Otherwise, the controller 140 adjusts the peak magnitude $I_{PK}$ of the load current $I_{LOAD}$ and the target bus voltage $V_{BUS-TRGT}$ is maintained constant. Alternatively, the controller 140 could be operable to slow down the speed of control of the peak magnitude $I_{PK}$ of the load current $I_{LOAD}$ or the target bus voltage $V_{BUS-TRGT}$ rather than simply freezing control of these parameters.

Figure 6:
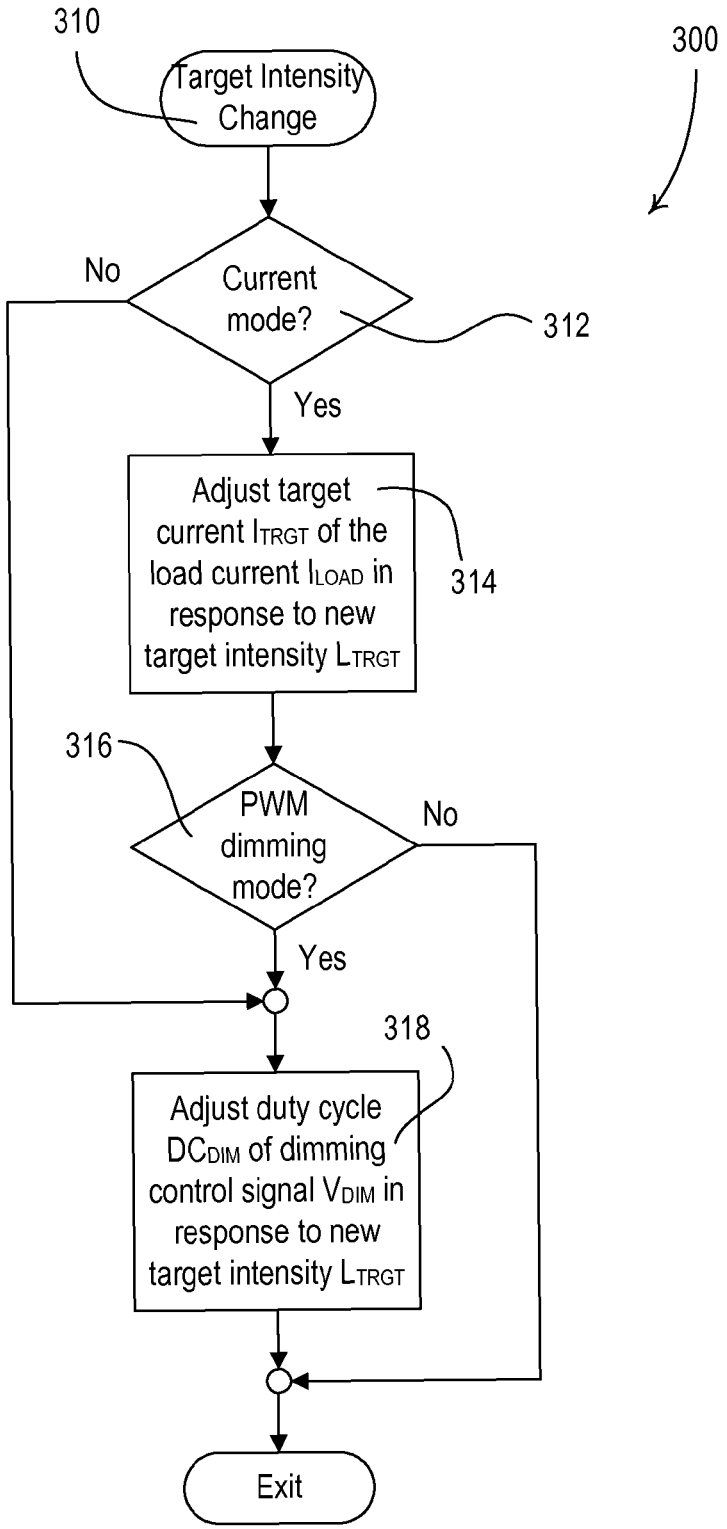
FIG. 6 is a simplified flowchart of a target intensity procedure executed by a controller of the LED driver of FIG. 1.

FIG. 6 is a simplified flowchart of a target intensity procedure 300 executed by the controller 140 of the LED driver 100 (when both the target load current $I_{TRGT}$ or the dimming method are known). The controller 140 executes the target intensity procedure 300 when the target intensity $L_{TRGT}$ changes at step 310, for example, in response to a change in the DC magnitude of the target intensity control signal $V_{TRGT}$ generated by the phase-control input circuit 160. If the LED driver 100 is operating in the current load control mode (as stored in the memory 170) at step 312, the controller 140 adjusts the duty cycle $DC_{IPK}$ of the peak current control signal $V_{IPK}$ in response to the new target load current $I_{TRGT}$ at step 314. If the LED driver is using the PWM dimming technique (as stored in the memory 170) at step 316, the controller 140 adjusts the duty cycle $DC_{DIM}$ of the dimming control signal $V_{DIM}$ in response to the new target intensity $L_{TRGT}$ at step 318 and the target intensity procedure 300 exits. If the LED driver 100 is operating in the current load control mode at step 312, but with the CCR dimming technique at step 316, the controller 140 only adjusts the target load current $I_{TRGT}$ of the load current $I_{LOAD}$ in response to the new target intensity $L_{TRGT}$ at step 314 by adjusting the duty cycle $DC_{IPK}$ of the peak current control signal $V_{IPK}$, so as to control the magnitude of the load current $I_{LOAD}$ towards the target load current $I_{TRGT}$. If the LED driver 100 is operating in the voltage load control mode at step 312, the controller 140 only adjusts the duty cycle $DC_{DIM}$ of the dimming control signal $V_{DIM}$ in response to the new target intensity $L_{TRGT}$ at step 318 and the target intensity procedure 300 exits.

Figure 7:
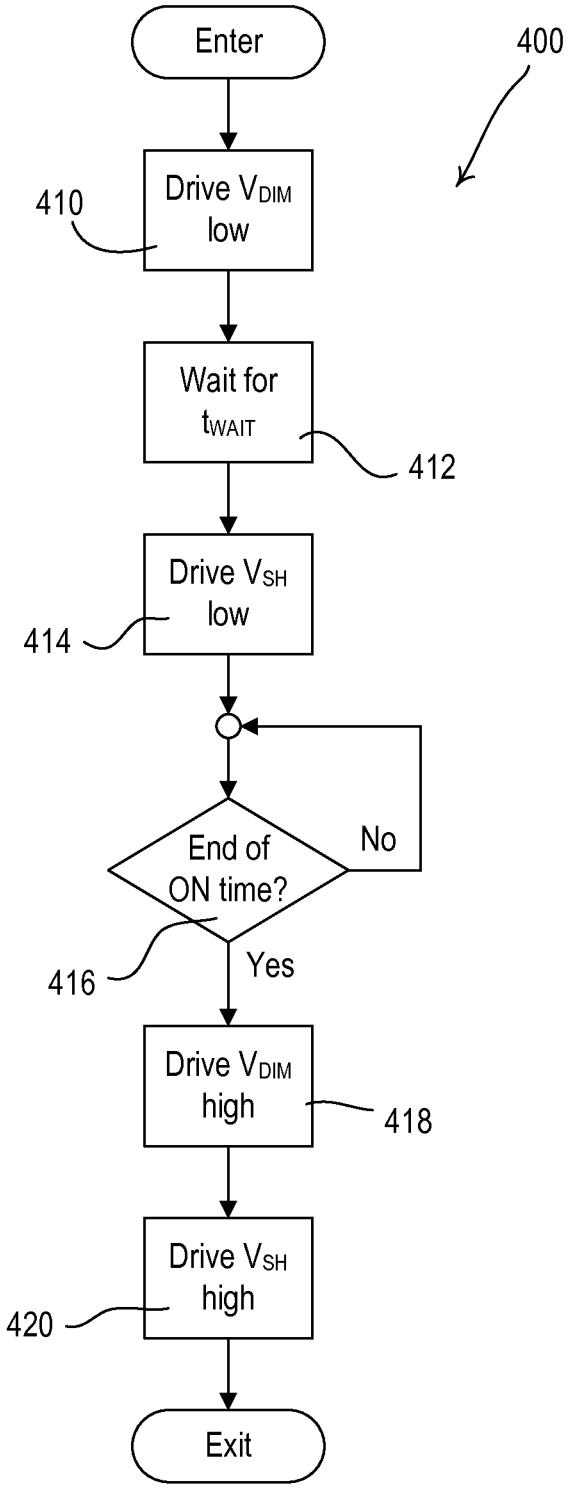
FIG. 7 is a simplified flowchart of a PWM dimming procedure executed by the controller of the LED driver of FIG. 1.

FIG. 7 is a simplified flowchart of a PWM dimming procedure 400 executed periodically by the controller 140, e.g., every two milliseconds, when the LED driver 100 is operating in the PWM dimming mode, such that the controller generates the dimming control signal $V_{DIM}$ at the constant PWM frequency $f_{PWM}$. First, the controller 140 immediately drives the dimming control signal $V_{DIM}$ low (i.e., to approximately circuit common) at step 410 to thus render the dimming FET Q250 non-conductive and the regulation FET Q232 conductive. The controller 140 then waits for a predetermined period of time $t_{WAIT}$ (e.g. approximately 12 μsec) at step 412 to allow the magnitude of the regulation voltage $V_{REG}$ to settle, before driving the sample and hold control signal $V_{SH}$ low at step 414 to render the FET Q261 of the sample and hold circuit 260 conductive to charge the capacitor C262 to approximately the magnitude of the regulation voltage $V_{REG}$. At the end of the on time $t_{ON}$ of the present PWM cycle of the dimming control signal $V_{DIM}$ at step 416, the controller 140 drives the dimming control signal $V_{DIM}$ high (i.e., to approximately the third non-isolated supply voltage $V_{CC3}$) at step 418 to render the regulation FET Q232 non-conductive, and drives the sample and hold control signal $V_{SH}$ high at step 420 to render the FET Q261 of the sample and hold circuit 260 non-conductive, before the PWM dimming procedure 400 exits.

Figure 8:
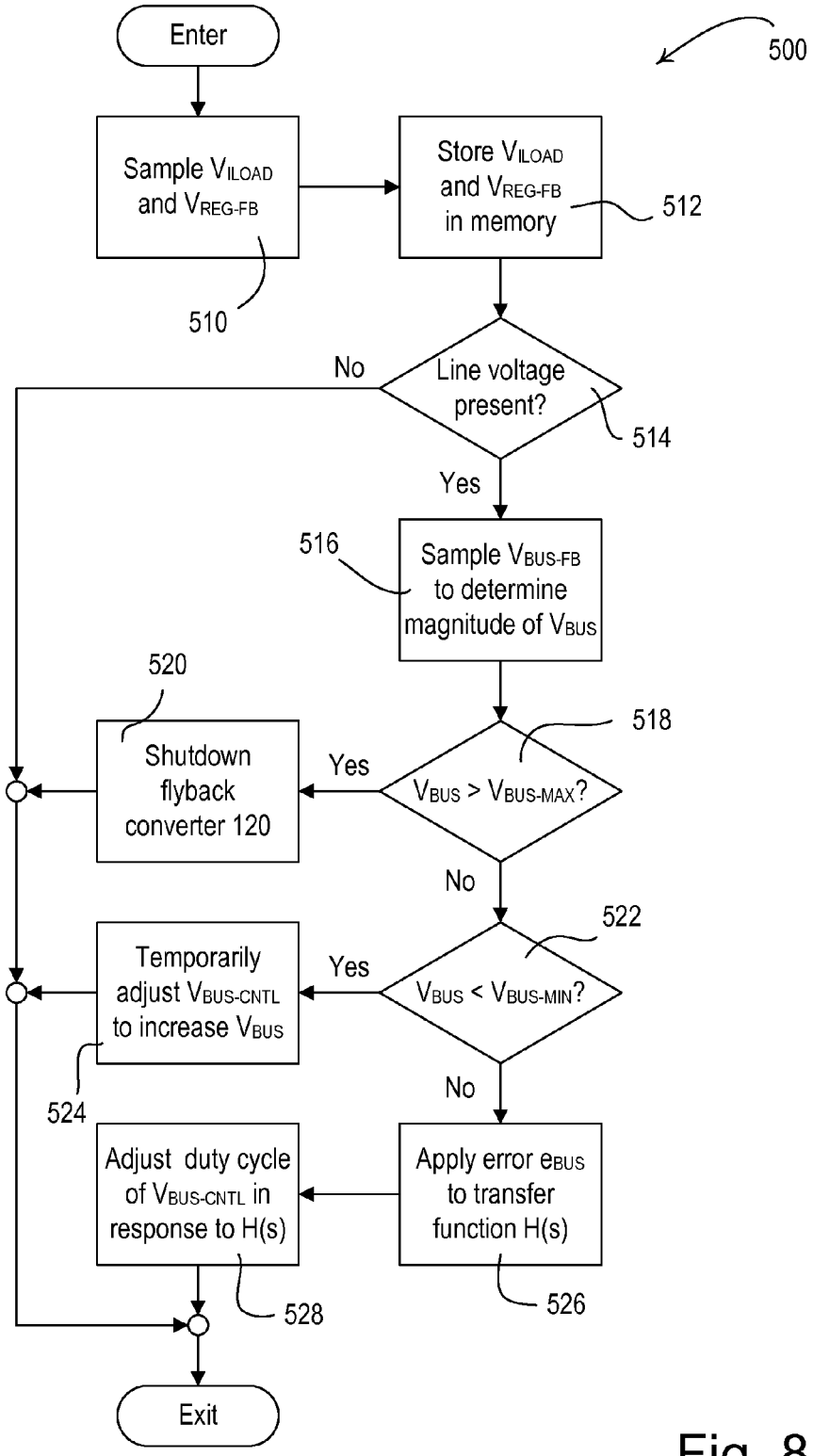
FIG. 8 is a simplified flowchart of a bus voltage control procedure executed by the controller of the LED driver of FIG. 1.

FIG. 8 is a simplified flowchart of a bus voltage control procedure 500 executed periodically by the controller 140 (e.g., approximately every 104 μsec) to control the bus voltage control signal $V_{BUS-CNTL}$ provided to the flyback converter 120. As shown in FIG. 5, the controller 140 uses the controller transfer function H(s) to control the magnitude of the bus voltage $V_{BUS}$ to the target bus voltage $V_{BUS-TRGT}$. After starting the bus voltage control procedure 500, the controller 140 first samples the load current feedback signal $V_{ILOAD}$ and the regulator voltage feedback signal $V_{REG-FB}$ at step 510 and stores the samples values in the memory 170 for later use at step 512. If line voltage is not present at the LED driver 100 at step 514, the bus voltage control procedure 500 simply exits, such that duty cycle $DC_{BUS}$ of the bus voltage control signal $V_{BUS-CNTL}$ provided to the flyback converter 120 remains constant in the event of a line voltage dropout to prevent windup of the flyback control circuit 222. If line voltage is present at step 514, the controller 140 samples the bus voltage feedback signal $V_{BUS-FB}$ at step 516 to determine the magnitude of the bus voltage $V_{BUS}$.

Next, the controller 140 determines if the magnitude of the bus voltage $V_{BUS}$ is outside of a predetermined range. If so, the controller 140 bypasses normal control of the bus voltage, i.e., using transfer function H(s), in order to quickly control the bus voltage to be within the predetermined range and prevent overshooting of the bus voltage $V_{BUS}$. Specifically, if the magnitude of the bus voltage $V_{BUS}$ is greater than the maximum bus voltage threshold $V_{BUS-MAX}$ at step 518, the controller 140 shuts down the operation of the flyback converter 120 at step 520, such that the flyback switching FET Q212 is rendered non-conductive and the bus voltage $V_{BUS}$ quickly decreases in magnitude. If the magnitude of the bus voltage is less than a minimum bus voltage threshold $V_{BUS-MIN}$ at step 522, the controller 140 temporarily adjusts the bus voltage control signal $V_{BUS-CNTL}$ at step 524 to quickly increase the magnitude of the bus voltage $V_{BUS}$. If the magnitude of the bus voltage $V_{BUS}$ is within the predetermined range at steps 518 and 522, the controller 140 applies the bus voltage error $e_{BUS}$ (i.e., $e_{BUS}=V_{BUS-TRGT}-V_{BUS}$) to the transfer function H(s) at step 526 and adjusts the duty cycle $DC_{BUS}$ of the bus voltage control signal $V_{BUS-CNTL}$ in response to the output of the transfer function at step 528, such that the magnitude of the bus voltage $V_{BUS}$ is controlled towards the target bus voltage $V_{BUS-TRGT}$.

Figure 9:
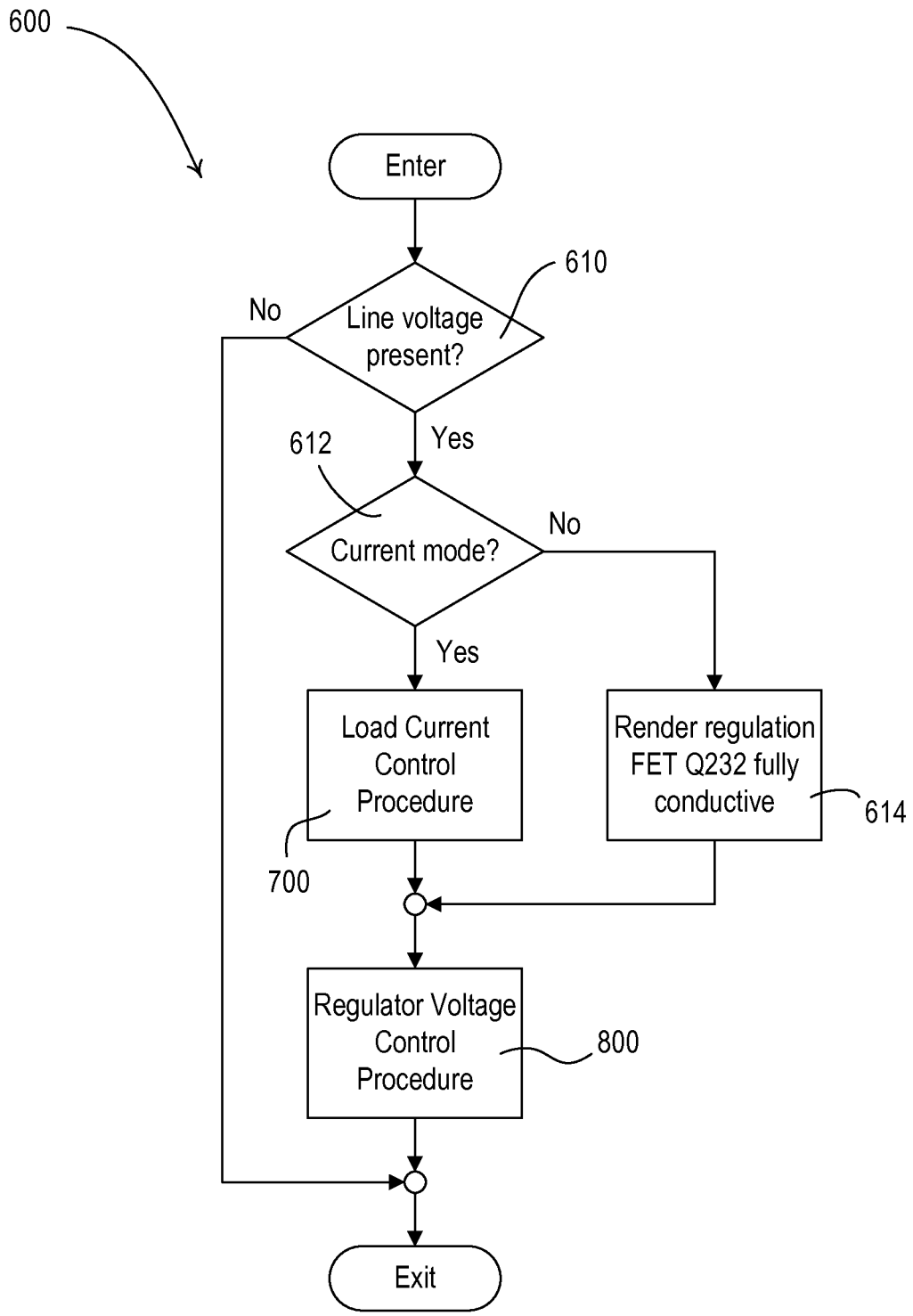
FIG. 9 is a simplified flowchart of a load control procedure executed periodically by the controller of the LED driver of FIG. 1.

FIG. 9 is a simplified flowchart of a load control procedure 600 executed periodically by the controller 140, e.g., every two milliseconds, such that the load control procedure is executed at the end of each PWM cycle of the dimming control signal $V_{DIM}$ when the LED driver 100 is operating in the PWM dimming mode. If line voltage is not present at step 610, the load control procedure 600 simply exits, such that the bus voltage control signal $V_{BUS-CNTL}$ and the peak current control signal $V_{IPK}$ remain constant in the event of a line voltage dropout. If line voltage is present at step 610 and the LED driver 100 is operating in the current mode at step 612, the controller 140 executes a load current control procedure 700 to adjust the peak current control signal $V_{IPK}$ and then executes a regulator voltage control procedure 800 to adjust the target bus voltage $V_{BUS-TRGT}$, before the load control procedure 600 exits. If the LED driver 100 is operating in the voltage mode at step 612, the controller 140 controls the peak current control signal $V_{IPK}$ so as to render the regulation FET Q232 fully conductive at step 614 and then executes the regulator voltage control procedure 800, before the load control procedure 600 exits.

Figure 10:
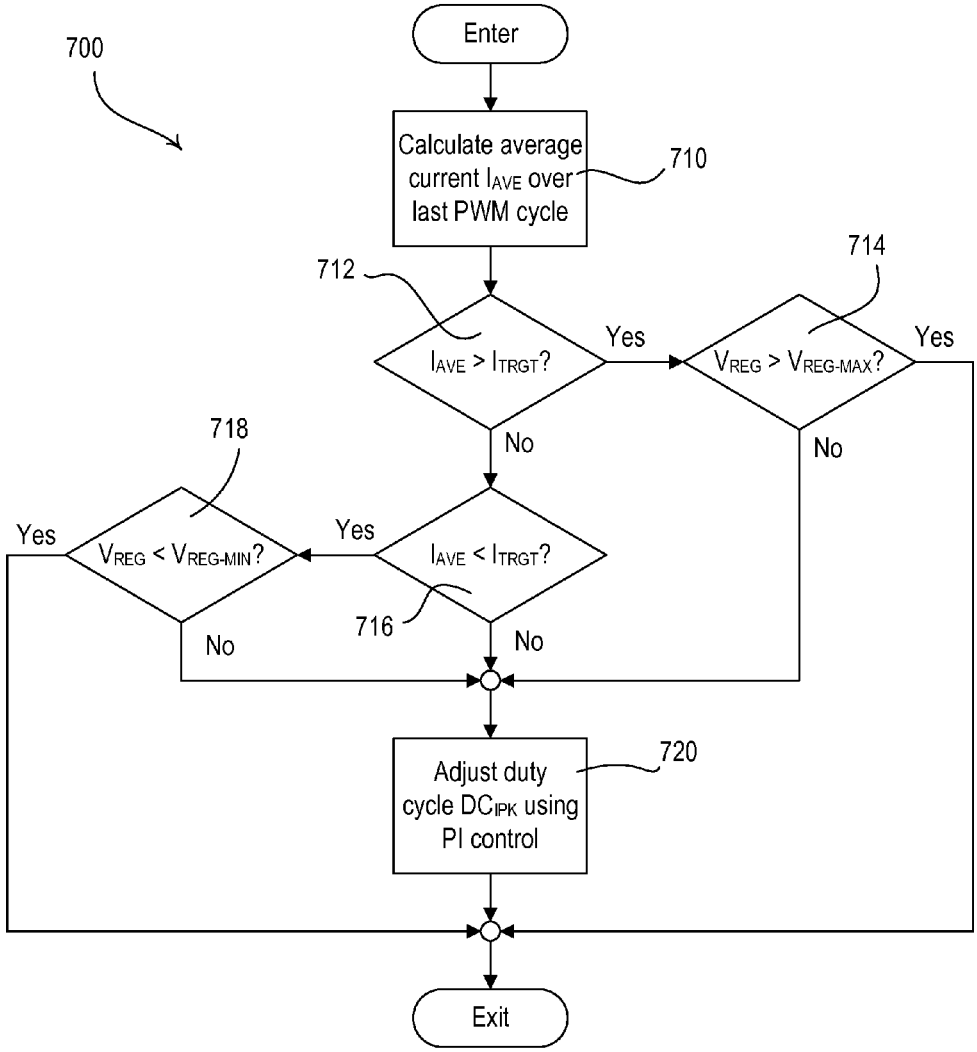
FIG. 10 is a simplified flowchart of a load current control procedure executed by the controller of the LED driver of FIG. 1.

FIG. 10 is a simplified flowchart of the load current control procedure 700 executed by the controller 140 to adjust the peak current control signal $V_{IPK}$ and thus the peak magnitude $I_{PK}$ of the load current $I_{LOAD}$. At step 710, the controller 140 first calculates the average magnitude $I_{AVE}$ of the load current $I_{LOAD}$ over the last PWM cycle (i.e., to provide additional software filtering of the load current feedback signal $V_{ILOAD}$). If the average magnitude $I_{AVE}$ of the load current $I_{LOAD}$ is greater than the target load current $I_{TRGT}$ at step 712 and the magnitude of the regulator voltage $V_{REG}$ is greater than the maximum regulator voltage threshold $V_{REG-MAX}$ at step 714, the regulation FET Q232 may be in danger of dissipating too much power, so the load current control procedure 700 exits to allow the regulator voltage control procedure 800 to adjust the target bus voltage $V_{BUS-TRGT}$ and thus reduce the magnitude of the regulator voltage $V_{REG}$ as will be described in greater detail below with reference to FIG. 11. If the average magnitude $I_{AVE}$ of the load current $I_{LOAD}$ is less than the target load current $I_{TRGT}$ at step 716 and the magnitude of the regulator voltage $V_{REG}$ is less than the minimum regulator voltage threshold $V_{REG-MIN}$ at step 718, the regulator voltage $V_{REG}$ may be in danger of collapsing towards zero volts, so the load current control procedure 700 exits to allow the regulator voltage control procedure 800 to adjust the target bus voltage $V_{BUS-TRGT}$ and thus increase the magnitude of the regulator voltage $V_{REG}$ as will be described in greater detail below with reference to FIG. 11. Otherwise, the controller 140 adjusts the duty cycle $DC_{IPK}$ of the peak current control signal $V_{IPK}$ using the PI control algorithm at step 720 and the load current control procedure 700 exits.

Figure 11:
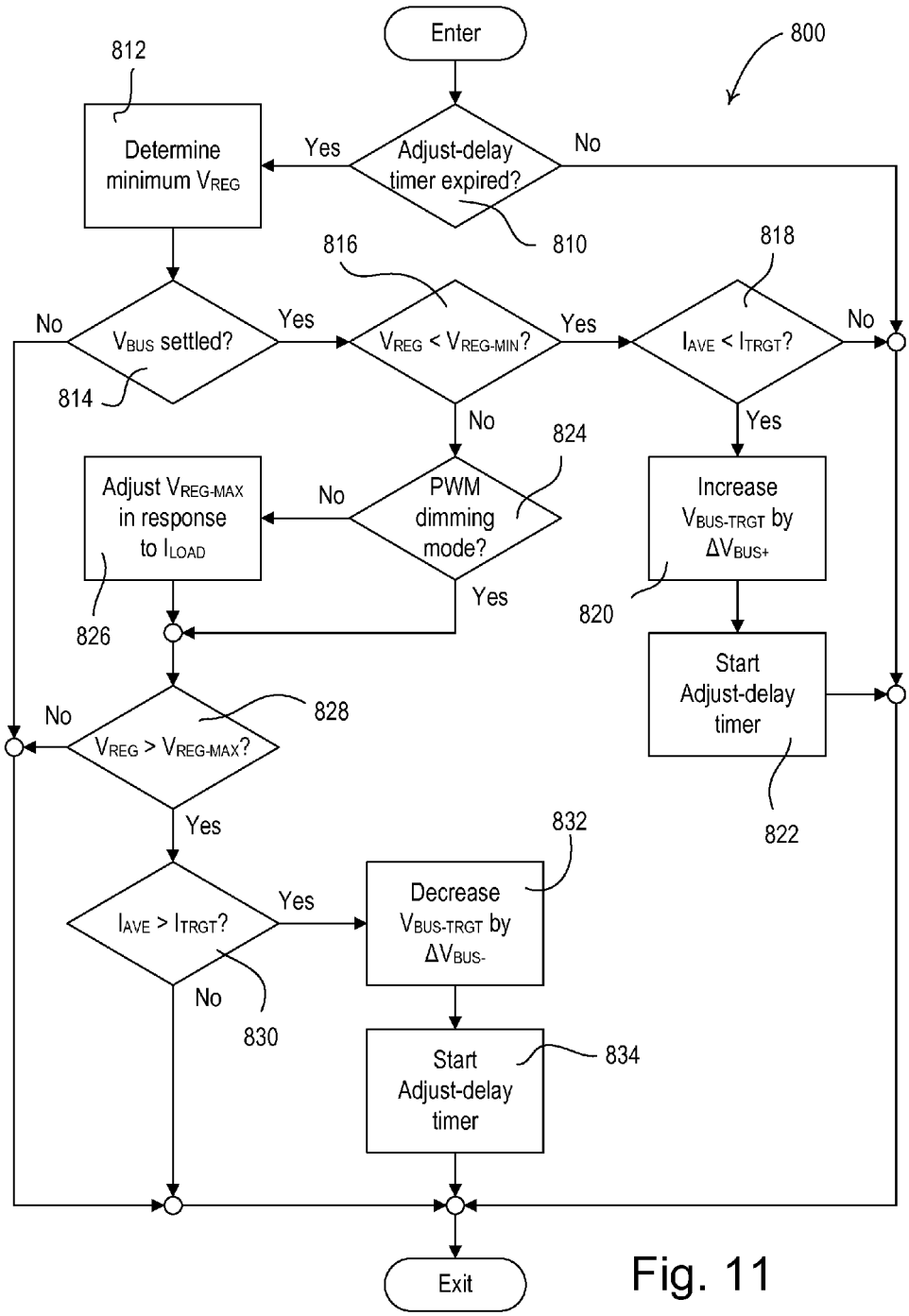
FIG. 11 is a simplified flowchart of a regulator voltage control procedure executed by the controller of the LED driver of FIG. 1.

FIG. 11 is a simplified flowchart of the regulator voltage control procedure 800 executed by the controller 140 to adjust the target bus voltage $V_{BUS-TRGT}$ and thus the magnitude of the regulator voltage $V_{REG}$. The controller 140 uses a delay-adjust timer to prevent the target bus voltage $V_{BUS-TRGT}$ from being adjusted too often. Accordingly, if the delay-adjust timer has not expired at step 810 when the regulator voltage control procedure 800 is executed, the procedure simply exits. However, if the delay-adjust timer has expired at step 810, the controller 140 determines the minimum magnitude of the regulator voltage $V_{REG}$ over the last half-cycle of the AC power source 104 (i.e., the last 8.33 msec) at step 812. If the magnitude of the bus voltage $V_{BUS}$ is not within predetermined limits (with respect to the target bus voltage $V_{BUS-TRGT}$) at step 814 (indicating that the bus voltage has not settled to a steady state value after a previous change in the target bus voltage $V_{BUS-TRGT}$), the regulator voltage control procedure 800 exits without adjusting the target bus voltage $V_{BUS-TRGT}$.

However, if the bus voltage $V_{BUS}$ is stable at step 814, the controller 140 determines if the target bus voltage $V_{BUS-TRGT}$ should be adjusted. Specifically, if the magnitude of the regulator voltage $V_{REG}$ is less than the minimum regulator voltage threshold $V_{REG-MIN}$ at step 816 and the average magnitude $I_{AVE}$ of the load current $I_{LOAD}$ is less than the target load current $I_{TRGT}$ at step 818, the controller 140 increases the target bus voltage $V_{BUS-TRGT}$ by the predetermined amount $\Delta V_{BUS+}$ at step 820 to thus increase the magnitude of the regulator voltage $V_{REG}$ and prevent the regulator voltage from collapsing towards zero volts. The controller 140 then initializes the adjust-delay timer to a first delay time $t_{DELAY+}$ (e.g., approximately 25 msec) and starts the timer counting down with respect to time at step 822, before the regulator voltage control procedure 800 exits. Accordingly, the controller 140 will not adjust the target bus voltage $V_{BUS-TRGT}$ again when the regulator voltage control procedure 800 is executed until the adjust-delay timer expires at step 810.

If the magnitude of the regulator voltage $V_{REG}$ is not less than the minimum regulator voltage threshold $V_{REG-MIN}$ at step 816, the controller 140 then determines if the regulation FET Q232 may be dissipating too much power. If the LED driver 100 is operating in the CCR dimming mode at step 824, the controller 140 adjusts the maximum regulator voltage threshold $V_{REG-MAX}$ in response to the average magnitude $I_{AVE}$ of the load current $I_{LOAD}$ at step 826, such that the power dissipated in the regulation FET Q232 is limited to the predetermined constant maximum power $P_{FET-MAX}$. If the LED driver 100 is operating in the PWM dimming mode at step 824, the controller 140 uses the predetermined constant value for the maximum regulator voltage threshold $V_{REG-MAX}$ (i.e., approximately 0.6 volts). If the magnitude of the regulator voltage $V_{REG}$ is greater than the maximum regulator voltage threshold $V_{REG-MAX}$ at step 828 and the average magnitude $I_{AVE}$ of the load current $I_{LOAD}$ is greater than the target load current $I_{TRGT}$ at step 830, the controller 140 decreases the target bus voltage $V_{BUS-TRGT}$ by the predetermined amount $\Delta V_{BUS-}$ at step 832 to thus decrease the magnitude of the regulator voltage $V_{REG}$ and prevent the regulation FET Q232 from dissipating too much power. The controller 140 then initializes the adjust-delay timer to a second delay time $t_{DELAY-}$ (e.g., approximately 125 msec) and starts the timer counting down with respect to time at step 834, before the regulator voltage control procedure 800 exits.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A load control device for controlling the intensity of an lighting load, the load control device comprising:

a power converter circuit operable to receive a rectified AC voltage and to generate a DC bus voltage;

a load control circuit operable to receive the bus voltage and to control the magnitude of a load current conducted through the lighting load, the load control circuit comprising a controllable-impedance circuit adapted to be coupled in series with the lighting load; and a controller operatively coupled to the power converter circuit for adjusting the magnitude of the bus voltage to a target bus voltage, so as to control the magnitude of a controllable-impedance voltage generated across the controllable-impedance circuit, the controller operatively coupled to the load control circuit for generating a drive signal for controlling the controllable-impedance circuit to thus adjust the magnitude of the load current through the lighting load;

wherein the controller is operable to control both the magnitude of the load current and the magnitude of the controllable-impedance voltage to adjust the intensity of the lighting load, the controller operable to control the magnitude of the controllable-impedance voltage by simultaneously maintaining the magnitude of the drive signal constant and adjusting the target bus voltage.

2. The load control device of claim 1, wherein the controller receives a controllable-impedance voltage feedback signal representative of the magnitude of the controllable-impedance voltage generated across the controllable-impedance circuit, the controller operable to adjust the target bus voltage in response to the controllable-impedance voltage feedback signal to thus adjust the magnitude of the controllable-impedance voltage.

3. The load control device of claim 2, wherein the controller receives a load current feedback signal representative of the average magnitude of the load current, the controller operable to control the controllable-impedance circuit in response to the load current feedback signal to adjust the magnitude of the load current to a target load current.

4. The load control device of claim 3, wherein the controller receives a bus voltage feedback signal representative of the magnitude of the bus voltage, the controller operable to control the power converter circuit in response to the bus voltage feedback signal to adjust the magnitude of the bus voltage to the target bus voltage.

5. The load control device of claim 4, wherein the controller generates a bus voltage control signal for controlling the power converter circuit, the controller operable to maintain the magnitude of the bus voltage control signal constant if line voltage is not present at an input terminal of the load control device.

6. The load control device of claim 3, wherein, if the magnitude of the load current is below a load current threshold and the magnitude of the controllable-impedance voltage is below a controllable-impedance voltage threshold, the controller maintains the magnitude of the drive signal constant, and increases the target bus voltage, so as to increase the magnitude of the controllable-impedance voltage.

7. The load control device of claim 3, wherein, if the magnitude of the load current is above a load current threshold and the magnitude of the controllable-impedance voltage is above a controllable-impedance voltage threshold, the controller maintains the magnitude of the drive signal constant, and decreases the target bus voltage, so as to decrease the magnitude of the controllable-impedance voltage.

8. The load control device of claim 3, wherein, if the magnitude of the load current and the magnitude of the controllable-impedance voltage are with predetermined limits, the controllers maintains the target bus voltage constant and controls the controllable-impedance circuit to adjust the magnitude of the load current to the target load current.

9. The load control device of claim 2, wherein the controller is operable to adjust the target bus voltage if the bus voltage is in a steady state condition.

10. The load control device of claim 9, wherein the controller is operable to adjust the target bus voltage if the magnitude of the bus voltage is within predetermined limits with respect to the target bus voltage.

11. The load control device of claim 2, wherein the controller is operable to adjust the target bus voltage if line voltage is present at an input terminal of the load control device.

12. The load control device of claim 1, wherein the controllable-impedance circuit comprises a linear regulator.

13. The load control device of claim 12, wherein the linear regulator comprises a regulation transistor adapted to be coupled in series with the lighting load, the control circuit operable to control the regulation transistor to operate in the linear region to thus control the magnitude of the load current conducted through the lighting load.

14. The load control device of claim 13, wherein the load control circuit comprises a sample and hold circuit coupled to the regulation transistor for receiving the voltage generated across the controllable-impedance circuit, and generating a controllable-impedance voltage feedback signal representative of the voltage generated across the regulation transistor, the feedback signal representative of the magnitude of the voltage generated across the linear regulator when the regulation transistor is conductive.

15. The load control device of claim 14, wherein, if the magnitude of the load current is below a load current threshold and the magnitude of the controllable-impedance voltage is below a controllable-impedance voltage threshold, the controller maintains the magnitude of the drive signal constant, and increases the target bus voltage, so as to increase the magnitude of the controllable-impedance voltage.

16. The load control device of claim 15, wherein, if the magnitude of the load current is above a load current threshold and the magnitude of the controllable-impedance voltage is above a controllable-impedance voltage threshold, the controller maintains the magnitude of the drive signal constant, and decreases the target bus voltage, so as to decrease the magnitude of the controllable-impedance voltage.

17. The load control device of claim 13, wherein the controller is operable to adjust the target bus voltage if the magnitude of the controllable-impedance voltage is below a minimum controllable-impedance voltage threshold or above a maximum controllable-impedance voltage threshold.

18. The load control device of claim 17, wherein the controller is operable to adjust the maximum controllable-impedance voltage threshold in response to the load current feedback signal, such that the power dissipated in the regulation transistor is limited to a predetermined constant maximum power.

19. The load control device of claim 1, wherein the lighting load comprises an LED light source and the load control circuit comprises an LED drive circuit.

20. The load control device of claim 1, wherein the controller is operable to adjust the target bus voltage if the magnitude of the controllable-impedance voltage is below a minimum controllable-impedance voltage threshold or above a maximum controllable-impedance voltage threshold.

21. An LED driver for controlling the intensity of an LED light source, the LED driver comprising:

a power converter circuit operable to receive a rectified AC voltage and to generate a DC bus voltage;

an LED drive circuit operable to receive the bus voltage and to control the magnitude of a load current conducted through the LED light source to thus control the intensity of the LED light source, the LED drive circuit comprising a controllable-impedance circuit adapted to be coupled in series with the LED light source; and a controller operatively coupled to the power converter circuit for adjusting the magnitude of the bus voltage to a target bus voltage, so as to control the magnitude of a regulator voltage generated across the controllable-impedance circuit, the controller operatively coupled to the LED drive circuit for generating a drive signal for controlling the controllable-impedance circuit to thus adjust the magnitude of the load current through the LED light source;

wherein, if the magnitude of the load current is below a load current threshold and the magnitude of the regulator voltage is below a regulator voltage threshold, the controller maintains the magnitude of the drive signal constant, and increases the target bus voltage, so as to increase the magnitude of the regulator voltage.

22. An LED driver for controlling the intensity of an LED light source, the LED driver comprising:

a power converter circuit operable to receive a rectified AC voltage and to generate a DC bus voltage;

an LED drive circuit operable to receive the bus voltage and to control the magnitude of a load current conducted through the LED light source to thus control the intensity of the LED light source, the LED drive circuit comprising a controllable-impedance circuit adapted to be coupled in series with the LED light source; and a controller operatively coupled to the power converter circuit for adjusting the magnitude of the bus voltage to a target bus voltage, so as to control the magnitude of a regulator voltage generated across the controllable-impedance circuit, the controller operatively coupled to the LED drive circuit for generating a drive signal for controlling the controllable-impedance circuit to thus adjust the magnitude of the load current through the LED light source;

wherein, if the magnitude of the load current is above a load current threshold and the magnitude of the regulator voltage is above a regulator voltage threshold, the controller maintains the magnitude of the drive signal constant, and decreases the target bus voltage, so as to decrease the magnitude of the regulator voltage.

* * * * *